US010035959B2

(12) United States Patent
Sundararaman et al.

(10) Patent No.: US 10,035,959 B2
(45) Date of Patent: Jul. 31, 2018

(54) SLURRY HYDROCONVERSION USING ENHANCED SLURRY CATALYSTS

(71) Applicants: Ramanathan Sundararaman, Frederick, MD (US); Thomas Francis Degnan, Jr., Philadelphia, PA (US); Rustom Merwan Billimoria, Hellertown, PA (US); Natalie Ann Fassbender, Nazareth, PA (US); Manuel A. Francisco, Phillipsburg, NJ (US); Anjaneya Sarma Kovvali, Fairfax, VA (US); Randolph J. Smiley, Hellertown, PA (US); John Peter Greeley, Gaithersburg, MD (US); William Ernest Lewis, Baton Rouge, LA (US); Roby Bearden, Jr., Baton Rouge, LA (US)

(72) Inventors: Ramanathan Sundararaman, Frederick, MD (US); Thomas Francis Degnan, Jr., Philadelphia, PA (US); Rustom Merwan Billimoria, Hellertown, PA (US); Natalie Ann Fassbender, Nazareth, PA (US); Manuel A. Francisco, Phillipsburg, NJ (US); Anjaneya Sarma Kovvali, Fairfax, VA (US); Randolph J. Smiley, Hellertown, PA (US); John Peter Greeley, Gaithersburg, MD (US); William Ernest Lewis, Baton Rouge, LA (US); Roby Bearden, Jr., Baton Rouge, LA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 278 days.

(21) Appl. No.: 14/308,905

(22) Filed: Jun. 19, 2014

(65) Prior Publication Data

US 2014/0374314 A1 Dec. 25, 2014

Related U.S. Application Data

(60) Provisional application No. 61/837,387, filed on Jun. 20, 2013.

(51) Int. Cl.

| | |
|---|---|
| ***C10G 47/26*** | (2006.01) |
| ***C10G 49/06*** | (2006.01) |
| ***C10G 49/12*** | (2006.01) |
| ***C10G 69/14*** | (2006.01) |
| ***C10G 49/04*** | (2006.01) |
| ***C10G 69/06*** | (2006.01) |
| ***C10G 9/00*** | (2006.01) |

(52) U.S. Cl.

CPC ..... *C10G 49/12* (2013.01); *C10G 9/005* (2013.01); *C10G 49/04* (2013.01); *C10G 49/06* (2013.01); *C10G 69/06* (2013.01); *C10G 69/14* (2013.01)

(58) Field of Classification Search

CPC ..... C10G 47/26; C10G 49/06; C10G 49/12

See application file for complete search history.

(56) References Cited

U.S. PATENT DOCUMENTS

| | | | | |
|---|---|---|---|---|
| 4,178,227 | A | 12/1979 | Aldridge et al. | |
| 4,606,809 | A * | 8/1986 | Garg | C10G 65/10 208/112 |
| 5,755,955 | A | 5/1998 | Benham et al. | |
| 6,511,937 | B1 | 1/2003 | Bearden, Jr. et al. | |
| 7,842,635 | B2 * | 11/2010 | Zhou | B01J 27/0515 502/102 |
| 2010/0122939 | A1 | 5/2010 | Bauer et al. | |
| 2011/0210045 | A1 * | 9/2011 | Kou | C10G 47/02 208/59 |
| 2012/0234726 | A1 * | 9/2012 | Morel | B01J 27/30 208/49 |
| 2013/0075303 | A1 * | 3/2013 | Heraud | B01J 23/883 208/50 |
| 2013/0112593 | A1 | 5/2013 | Montanari et al. | |

OTHER PUBLICATIONS

PCT Application No. PCT/US2014/043129, Communication from the International Searching Authority, Form PCT/ISA/220 and Form PCT/ISA/237, dated Sep. 15, 2014.

* cited by examiner

*Primary Examiner* — Randy Boyer

(74) *Attorney, Agent, or Firm* — Jamie L. Brewer; Kristina M. Leavitt; Andrew T. Ward

(57) ABSTRACT

Systems and methods are provided for slurry hydroconversion of a heavy oil feed, such as an atmospheric or vacuum resid. The systems and methods allow for slurry hydroconversion using catalysts with enhanced activity and/or catalysts that can be recycled as a side product from a complementary refinery process.

8 Claims, 6 Drawing Sheets

SLURRY HYDROCONVERSION USING ENHANCED SLURRY CATALYSTS

CROSS-REFERENCE TO RELATED APPLICATIONS

This application claims the benefit of priority from U.S. Provisional Application 61/837,387, filed on Jun. 20, 2013, titled "Slurry Hydroconversion Using Enhanced Slurry Catalysts", the entirety of which is incorporated herein by reference.

BACKGROUND OF THE INVENTION

Slurry hydroprocesssing provides a method for conversion of high boiling, low value petroleum fractions into higher value liquid products. Slurry hydroconversion technology can process difficult feeds, such as feeds with high CCR weights, while still maintaining high liquid yields. In addition to vacuum resid feeds, slurry hydroconversion units have been used to process other challenging streams present in refinery/petrochemical complexes such as deasphalted rock, steam cracked tar, and visbreaker tar. Unfortunately, slurry hydroconversion is also an expensive refinery process from both a capital investment standpoint and a hydrogen consumption standpoint.

Various slurry hydroconversion configurations have previously been described. For example, U.S. Pat. No. 5,755,955 and U.S. Patent Application Publication 2010/0122939 provide examples of configurations for performing slurry hydroconversion. U.S. Patent Application Publication 2011/0210045 also describes examples of configurations for slurry hydroconversion, including examples of configurations where the heavy oil feed is diluted with a stream having a lower boiling point range, such as a vacuum gas oil stream and/or catalytic cracking slurry oil stream, and examples of configurations where a bottoms portion of the product from slurry hydroconversion is recycled to the slurry hydroconversion reactor.

U.S. Patent Application Publication 2013/0075303 describes a reaction system for combining slurry hydroconversion with a coking process. An unconverted portion of the feed after slurry hydroconversion is passed into a coker for further processing. The resulting coke is described as being high in metals. This coke can be combusted to allow for recovery of the metals or as a suitable disposal process. The recovered metals are described as being suitable for forming a catalytic solution for use as a catalyst in the slurry hydroconversion process.

U.S. Patent Application Publication 2013/0112593 describes a reaction system for performing slurry hydroconversion on a deasphalted heavy oil feed. The asphalt from a deasphalting process and a portion of the unconverted material from the slurry hydroconversion can be gasified to form hydrogen and carbon oxides.

SUMMARY OF THE INVENTION

In an aspect, a method for processing a heavy oil feedstock is provided. The method includes providing a first heavy oil feedstock having a 10% distillation point of at least about 650° F. (343° C.) and a first Conradson carbon residue wt %; providing a second heavy oil feedstock having an initial boiling point of at least about 650° F. (343° C.) and a second Conradson carbon residue wt %; coking the first heavy oil feedstock under effective fluidized coking conditions to form at least a first plurality of liquid products and coke, the coke comprising coker fines containing at least one of Ni, V, or Fe; and exposing the second heavy oil feedstock to at least a portion of the coker fines under effective slurry hydroconversion conditions to form at least a second plurality of liquid products, the effective slurry hydroconversion conditions being effective for conversion of at least about 80 wt % of the second heavy oil feedstock relative to a conversion temperature, optionally at least about 90 wt %.

In another aspect, a method for processing a heavy oil feedstock is provided. The method includes providing a heavy oil feedstock having a 10% distillation point of at least about 650° F. (343° C.) and a first Conradson carbon residue wt %; and exposing the heavy oil feedstock to a plurality of slurry hydroconversion catalysts under effective slurry hydroconversion conditions to form at least a second plurality of liquid products, the effective slurry hydroconversion conditions being effective for conversion of at least about 80 wt % of the second heavy oil feedstock relative to a conversion temperature, optionally at least about 90 wt %, wherein the plurality of slurry hydroconversion catalysts comprise a first catalyst comprising a Group VI metal and a second catalyst comprising a non-noble Group VIII metal, a ratio of the non-noble Group VIII metal to the Group VI metal being from about 5:1 to about 25:1.

In still another aspect, a method for processing a heavy oil feedstock is provided. The method includes providing a heavy oil feedstock having a 10% distillation point of at least about 650° F. (343° C.) and a first Conradson carbon residue wt %; exposing the heavy oil feedstock to a slurry hydroconversion catalyst in a reactor under effective slurry hydroconversion conditions to form at least a plurality of liquid products, the effective slurry hydroconversion conditions being effective for conversion of at least about 80 wt % of the second heavy oil feedstock relative to a conversion temperature, optionally at least about 90 wt %; separating a vacuum gas oil product from the plurality of liquid products, the vacuum gas oil product further comprising at least a portion of the slurry hydroconversion catalyst; and recycling the vacuum gas oil product to the reactor, wherein the slurry hydroconversion catalyst is a bulk multimetallic catalyst comprising at least one non-noble Group VIII (Group 8-10) metal and at least one Group VIB (Group 6) metal, a weight of the slurry hydroconversion catalyst being about 5 wt % to 25 wt % of a weight of the heavy oil feedstock.

DETAILED DESCRIPTION OF THE EMBODIMENTS

Overview

Figure 1:
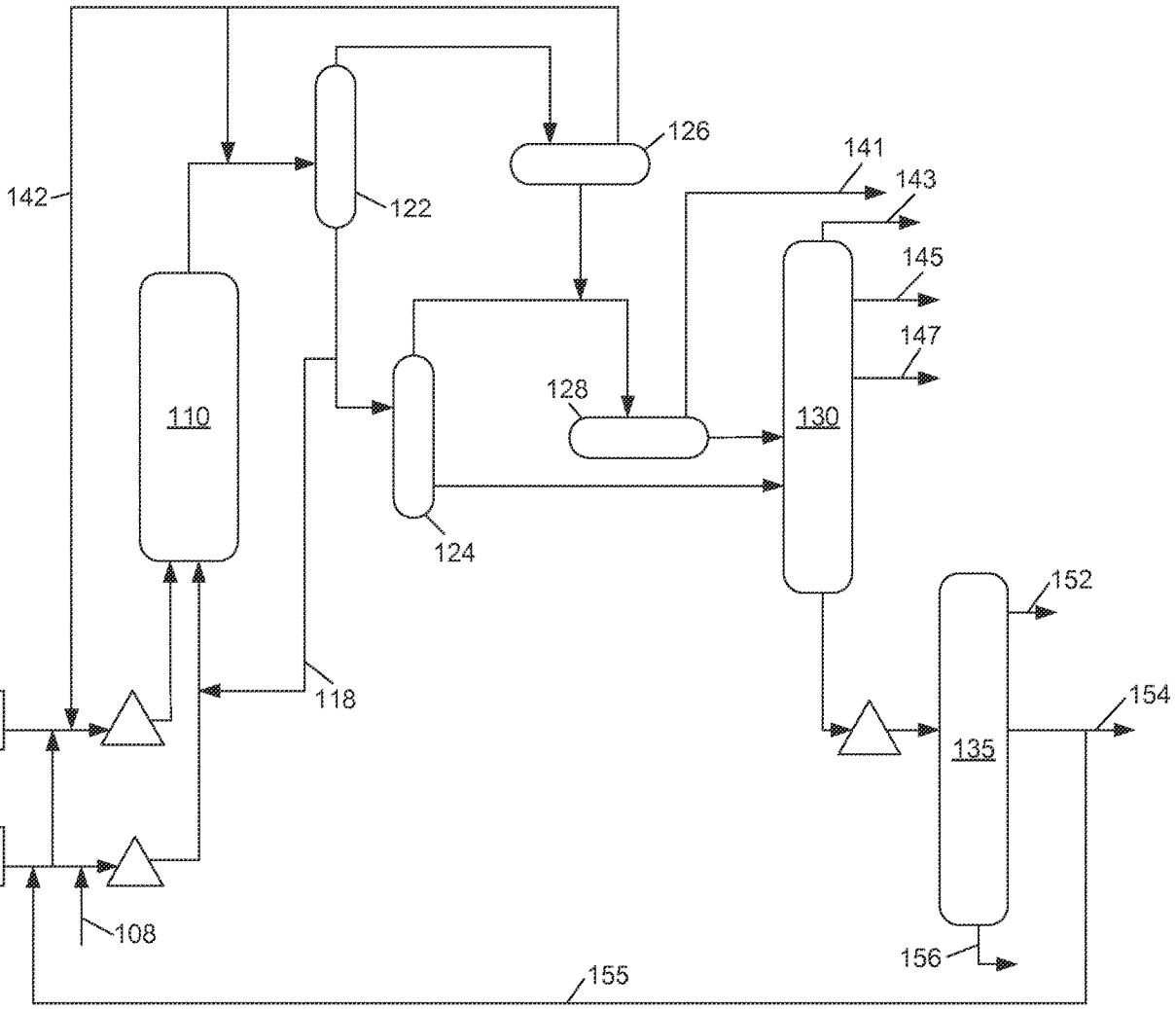
FIG. 1 shows an example of a slurry hydroconversion reaction system.

In various aspects, systems and methods are provided for slurry hydroconversion of a heavy oil feed, such as an atmospheric or vacuum resid. The systems and methods allow for slurry hydroconversion using catalysts with enhanced activity and/or catalysts that can be recycled as a side product from a complementary refinery process.

In some aspects, a slurry hydroconversion reaction system can be used in conjunction with a fluidized coker reaction system to allow for integrated recycling of metal additives in the slurry hydroconversion reaction system. In addition to the desired liquid conversion products, slurry hydroconversion typically generates pitch, which is a low value product that may require additional processing to allow for proper disposal. Additives or catalysts in the slurry hydroconversion reaction can be concentrated in the pitch generated during slurry hydroconversion. These metal additives can be recovered for recycle to the slurry hydroconversion reaction system by passing the pitch into a fluidized coking system. The metal additives can exit the fluidized coking system as coker fines that can be recycled.

In other aspects, slurry hydroconversion can be performed using a combination of an Mo-based catalyst and an Fe-based catalyst. Conventionally, Mo-based slurry hydroconversion catalysts exhibit higher activity. However, due to the high cost of Mo-based slurry hydroconversion catalysts, Fe-based catalysts are sometimes preferred. It has been discovered that using a combination of Mo-based catalyst and Fe-based catalyst leads to a synergistic improvement in overall catalyst activity that would not be expected based on the individual activities of the catalysts.

In still other aspects, slurry hydroconversion of vacuum resids can be performed using a catalyst that allows for both hydrocracking and hydrotreating in the slurry hydroconversion vessel(s). Instead of using a conventional slurry hydroconversion catalyst suitable for hydrocracking, a bulk multimetallic catalyst is used that also has substantial hydrotreating activity. This allows for generation of a low sulfur, low nitrogen product from the slurry hydroconversion stage(s) without the need for a separate hydrotreatment stage, such as a separate fixed bed hydrotreater.

In yet other aspects, a slurry hydroconversion reaction system can be enhanced by performing an improved separation on the products from slurry hydroconversion. Conventionally, the products from a slurry hydroconversion reactor can be separated using a high pressure, high temperature separator that operates at conditions similar to the slurry hydroconversion conditions. This results in an initial separation of the slurry hydroconversion products into a lighter portion that contains converted product molecules and a heavier portion that is a mixture of converted products and unconverted products or pitch. Additional separations are performed on this heavier portion in order to separate the desired converted products, such as vacuum gas oil boiling range molecules, from the pitch. A slurry hydroconversion reaction system can be enhanced by increasing the temperature for this initial high pressure, high temperature separation. This can reduce the amount of converted products that are included in the heavier fraction after separation. This smaller heavy fraction can then be recycled back to the slurry hydroconversion reaction stage(s) for further conversion.

Feedstocks

In various aspects, a hydroprocessed product is produced from a heavy oil feed component. Examples of heavy oils include, but are not limited to, heavy crude oils, distillation residues, heavy oils coming from catalytic treatment (such as heavy cycle bottom slurry oils from fluid catalytic cracking), thermal tars (such as oils from visbreaking, steam cracking, or similar thermal or non-catalytic processes), oils (such as bitumen) from oil sands and heavy oils derived from coal.

Heavy oil feedstocks can be liquid or semi-solid. Examples of heavy oils that can be hydroprocessed, treated or upgraded according to this invention include bitumens and residuum from refinery distillation processes, including atmospheric and vacuum distillation processes. Such heavy oils can have an initial boiling point of 650° F. (343° C.) or greater. Preferably, the heavy oils will have a 10% distillation point of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.). In this discussion, boiling points can be determined by a convenient method, such as ASTM D86, ASTM D2887, or another suitable standard method.

In addition to initial boiling points and/or 10% distillation points, other distillation points may also be useful in characterizing a feedstock. For example, a feedstock can be characterized based on the portion of the feedstock that boils above 1050° F. (566° C.). In some aspects, a feedstock can have a 70% distillation point of 1050° F. or greater, or a 60% distillation point of 1050° F. or greater, or a 50% distillation point of 1050° F. or greater, or a 40% distillation point of 1050° F. or greater.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 20° or less in one aspect, 150 or less in another aspect, and 10° or less in another aspect.

Heavy oils can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The invention is particularly suited to treating heavy oils containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

In various aspects of the invention, reference may be made to one or more types of fractions generated during distillation of a petroleum feedstock. Such fractions may include naphtha fractions, kerosene fractions, diesel fractions, and vacuum gas oil fractions. Each of these types of fractions can be defined based on a boiling range, such as a boiling range that includes at least 90 wt % of the fraction, and preferably at least 95 wt % of the fraction. For example, for many types of naphtha fractions, at least 90 wt % of the fraction, and preferably at least 95 wt %, can have a boiling point in the range of 85° F. (29° C.) to 350° F. (177° C.). For some heavier naphtha fractions, at least 90 wt % of the fraction, and preferably at least 95 wt %, can have a boiling point in the range of 85° F. (29° C.) to 400° F. (204° C.). For a kerosene fraction, at least 90 wt % of the fraction, and preferably at least 95 wt %, can have a boiling point in the range of 300° F. (149° C.) to 600° F. (288° C.). Alternatively, for a kerosene fraction targeted for some uses, such as jet fuel production, at least 90 wt % of the fraction, and preferably at least 95 wt %, can have a boiling point in the range of 300° F. (149° C.) to 550° F. (288° C.). For a diesel fraction, at least 90 wt % of the fraction, and preferably at least 95 wt %, can have a boiling point in the range of 400° F. (204° C.) to 750° F. (399° C.).

Slurry Hydroconversion

FIG. 1 shows an example of a reaction system suitable for performing slurry hydroconversion. The configuration in FIG. 1 is provided as an aid in understanding the general features of a slurry hydroconversion process. It should be understood that, unless otherwise specified, the conditions described in association with FIG. 1 can generally be applied to any convenient slurry hydroconversion configuration.

In FIG. 1, a heavy oil feedstock 105 is mixed with a catalyst 108 prior to entering one or more slurry hydroconversion reactors 110. The mixture of feedstock 105 and catalyst 108 can be heated prior to entering reactor 110 in order to achieve a desired temperature for the slurry hydroconversion reaction. A hydrogen stream 102 is also fed into reactor 110. Optionally, a portion of feedstock 105 can be mixed with hydrogen stream 102 prior to hydrogen stream 102 entering reactor 110. Optionally, feedstock 105 can also include a portion of recycled vacuum gas oil 155. Optionally, hydrogen stream 102 can also include a portion of recycled hydrogen 142.

The effluent from slurry hydroconversion reactor(s) 110 is passed into one or more separation stages. For example, an initial separation stage can be a high pressure, high temperature (HPHT) separator 122. A higher boiling portion from the HPHT separator 122 can be passed to a low pressure, high temperature (LPHT) separator 124 while a lower boiling (gas) portion from the HPHT separator 122 can be passed to a high temperature, low pressure (HTLP) separator 126. The higher boiling portion from the LPHT separator 124 can be passed into a fractionator 130. The lower boiling portion from LPHT separator 124 can be combined with the higher boiling portion from HPLT separator 126 and passed into a low pressure, low temperature (LPLT) separator 128. The lower boiling portion from HPLT separator 126 can be used as a recycled hydrogen stream 142, optionally after removal of gas phase contaminants from the stream such as $H_2S$ or $NH_3$. The lower boiling portion from LPLT separator 128 can be used as a flash gas or fuel gas 141. The higher boiling portion from LPLT separator 128 is also passed into fractionator 130.

In some configurations, HPHT separator 122 can operate at a temperature similar to the outlet temperature of the slurry hydroconversion reactor 110. This reduces the amount of energy required to operate the HPHT separator 122. However, this also means that both the lower boiling portion and the higher boiling portion from the HPHT separator 122 undergo the full range of distillation and further processing steps prior to any recycling of unconverted feed to reactor 110.

In an alternative configuration, the higher boiling portion from HPHT separator 122 is used as a recycle stream 118 that is added back into feed 105 for processing in reactor 110. In this type of alternative configuration, the effluent from reactor 110 can be heated to reduce the amount of converted material that is recycled via recycle stream 118. This allows the conditions in HPHT separator 122 to be separated from the reaction conditions in reactor 110.

In FIG. 1, fractionator 130 is shown as an atmospheric fractionator. The fractionator 130 can be used to form a plurality of product streams, such as a light ends or $C4^-$ stream 143, one or more naphtha streams 145, one or more diesel and/or distillate (including kerosene) fuel streams 147, and a bottoms fraction. The bottoms fraction can then be passed into vacuum fractionator 135 to form, for example, a light vacuum gas oil 152, a heavy vacuum gas oil 154, and a bottoms or pitch fraction 156. Optionally, other types and/or more types of vacuum gas oil fractions can be generated from vacuum fractionator 135. The heavy vacuum gas oil fraction 154 can be at least partially used to form a recycle stream 155 for combination with heavy oil feed 105.

In a reaction system, slurry hydroconversion can be performed by processing a feed in one or more slurry hydroconversion reactors. The reaction conditions in a slurry hydroconversion reactor can vary based on the nature of the catalyst, the nature of the feed, the desired products, and/or the desired amount of conversion.

With regard to catalyst, suitable catalyst concentrations can range from about 50 wppm to about 20,000 wppm (or about 2 wt %), depending on the nature of the catalyst. Catalyst can be incorporated into a hydrocarbon feedstock directly, or the catalyst can be incorporated into a side or slip stream of feed and then combined with the main flow of feedstock. Still another option is to form catalyst in-situ by introducing a catalyst precursor into a feed (or a side/slip stream of feed) and forming catalyst by a subsequent reaction.

Catalytically active metals for use in hydroprocessing can include those from Group IVB, Group VB, Group VIB, Group VIIB, or Group VIII of the Periodic Table. Examples of suitable metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

A catalyst in the form of a solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials can include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

In some aspects, it can be desirable to form catalyst for slurry hydroconversion in situ, such as forming catalyst from a metal sulfate (e.g., iron sulfate monohydrate) catalyst precursor or another type of catalyst precursor that decomposes or reacts in the hydroprocessing reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina).

The reaction conditions within a slurry hydroconversion reactor can include a temperature of about 400° C. to about 480° C., such as at least about 425° C., or about 450° C. or less. Some types of slurry hydroconversion reactors are operated under high hydrogen partial pressure conditions, such as having a hydrogen partial pressure of about 1200 psig (8.3 MPag) to about 3400 psig (23.4 MPag), for example at least about 1500 psig (10.3 MPag), or at least about 2000 psig (13.8 MPag). Examples of hydrogen partial pressures can be about 1200 psig (8.3 MPag) to about 3000 psig (20.7 MPag), or about 1200 psig (8.3 MPag) to about 2500 psig (17.2 MPag), or about 1500 psig (10.3 MPag) to about 3400 psig (23.4 MPag), or about 1500 psig (10.3 MPag) to about 3000 psig (20.7 MPag), or about 1500 psig (8.3 MPag) to about 2500 psig (17.2 MPag), or about 2000 psig (13.8 MPag) to about 3400 psig (23.4 MPag), or about 2000 psig (13.8 MPag) to about 3000 psig (20.7 MPag). Since the catalyst is in slurry form within the feedstock, the space velocity for a slurry hydroconversion reactor can be characterized based on the volume of feed processed relative to the volume of the reactor used for processing the feed. Suitable space velocities for slurry hydroconversion can range, for example, from about 0.05 $v/v/hr^{-1}$ to about 5 $v/v/hr^{-1}$, such as about 0.1 $v/v/hr^{-1}$ to about 2 $v/v/hr^{-1}$.

The reaction conditions for slurry hydroconversion can be selected so that the net conversion of feed across all slurry hydroconversion reactors (if there is more than one arranged in series) is at least about 80%, such as at least about 90%, or at least about 95%. For slurry hydroconversion, conversion is defined as conversion of compounds with boiling points greater than a conversion temperature, such as 975° F. (524° C.), to compounds with boiling points below the conversion temperature. Alternatively, the conversion temperature for defining the amount of conversion can be 1050° F. (566° C.). The portion of a heavy feed that is unconverted after slurry hydroconversion can be referred to as pitch or a bottoms fraction from the slurry hydroconversion.

Fluidized Coking

Fluidized coking is a refinery process in which a heavy petroleum feedstock, typically a non-distillable residue (resid) from atmospheric and/or vacuum fractionation, is converted to lighter, more valuable materials by thermal decomposition (coking) at temperatures from about 900° F. (482° C.) to about 1100° F. (593° C.). Conventional fluid coking is performed in a process unit comprised of a coking reactor and a heater or burner. A petroleum feedstock is injected into the reactor in a coking zone comprised of a fluidized bed of hot, fine, coke particles and is distributed relatively uniformly over the surfaces of the coke particles where it is cracked to vapors and coke. The vapors pass through a gas/solids separation apparatus, such as a cyclone, which removes most of the entrained coke particles. The vapor is then discharged into a scrubbing zone where the remaining coke particles are removed and the products cooled to condense the heavy liquids. The resulting slurry, which usually contains from about 1 to about 3 wt. % coke particles, is recycled to extinction to the coking zone. The balance of the vapors go to a fractionator for separation of the gases and the liquids into different boiling fractions.

Some of the coke particles in the coking zone flow downwardly to a stripping zone at the base of the reactor vessel where steam removes interstitial product vapors from, or between, the coke particles, and some adsorbed liquids from the coke particles. The coke particles then flow down a stand-pipe and into a riser that moves them to a burning, or heating zone, where sufficient air is injected to burn at least a portion of the coke and heating the remainder sufficiently to satisfy the heat requirements of the coking zone where the unburned hot coke is recycled. Net coke, above that consumed in the burner, is withdrawn as product coke.

Another type of fluid coking employs three vessels: a coking reactor, a heater, and a gasifier. Coke particles having carbonaceous material deposited thereon in the coking zone are passed to the heater where a portion of the volatile matter is removed. The coke is then passed to the gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater. Coke is also recycled from the heater to the coking reactor to supply the heat requirements of the reactor.

The rate of introduction of resid feedstock to a fluid coker is limited by the rate at which it can be converted to coke. The major reactions that produce coke involve cracking of aliphatic side chains from aromatic cores, demethylation of aromatic cores and aromatization. The rate of cracking of aliphatic side chains is relatively fast and results in the buildup of a sticky layer of methylated aromatic cores. This layer is relatively sticky at reaction temperature. The rate of de-methylation of the aromatic cores is relatively slow and limits the operation of the fluid coker. At the point of fluid bed bogging (defluidizing), the rate of sticky layer going to coke equals the rate of introduction of coke precursors from the resid feed. An acceleration of the reactions involved in converting the sticky material to dry coke would allow increased reactor throughput at a given temperature or coking at a lower temperature at constant throughput. Less gas and higher quality liquids are produced at lower coking temperatures. Sticky coke particles can agglomerate (become larger) and be carried under into the stripper section and cause fouling. When carried under, much of the sticky coke is sent to the burner, where this incompletely demethylated coke evolves methylated and unsubstituted aromatics via thermal cracking reactions that ultimately cause fouling and/or foaming problems in the acid gas clean-up units.

Figure 2:
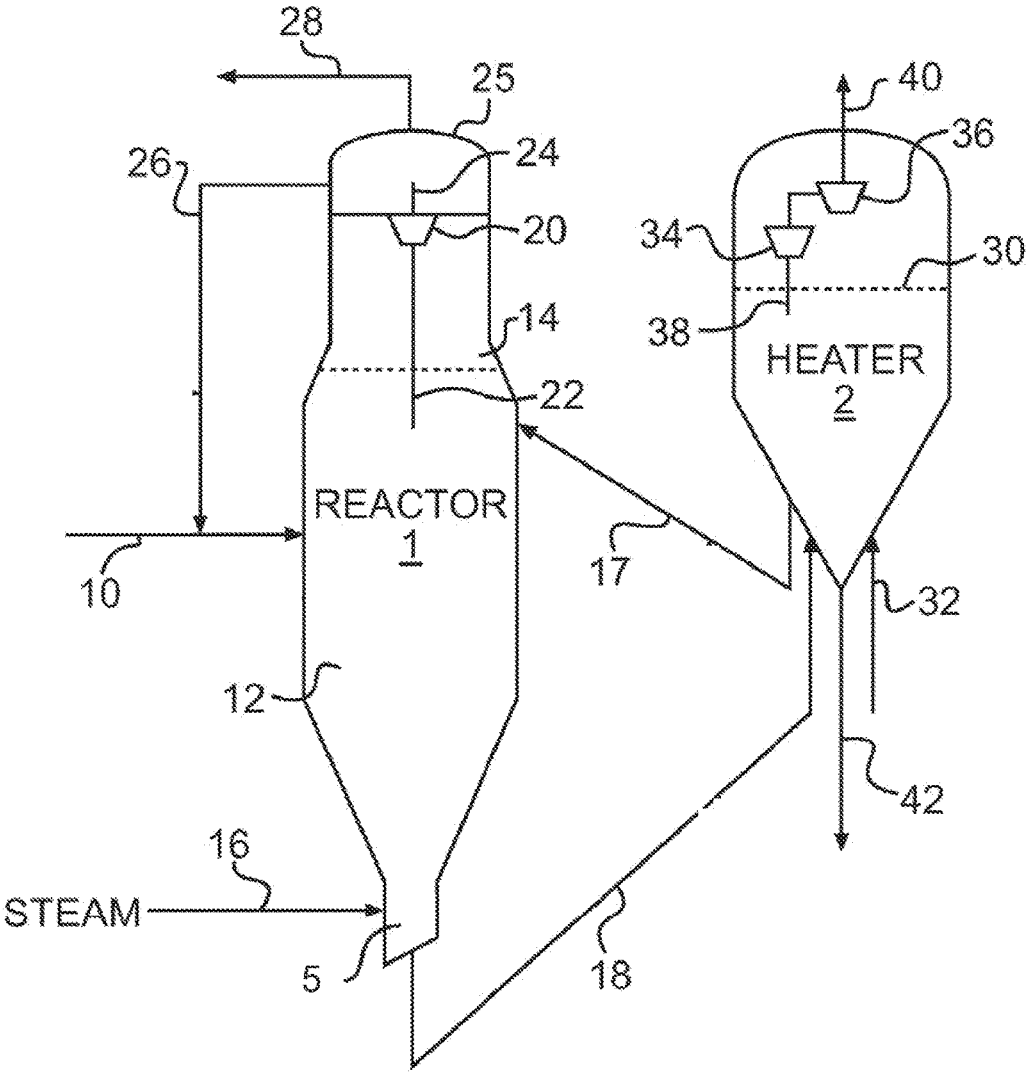
FIG. 2 shows an example of a fluidized coking reaction system.

Reference is now made to FIG. 2 hereof which shows a simplified flow diagram of a typical fluidized coking process unit comprised of a coking reactor and a heater. A heavy hydrocarbonaceous chargestock is conducted via line 10 into coking zone 12 that contains a fluidized bed of solids having an upper level indicated at 14. Although it is preferred that the solids, or seed material, be coke particles, they may also be any other refractory materials such as those selected from the group consisting of silica, alumina, zirconia, magnesia, alundum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns. For purposes of this FIG. 2, the solid particles will be referred to coke, or coke particles.

A fluidizing gas e.g., steam, is introduced at the base of coker reactor 1, through line 16, in an amount sufficient to obtained superficial fluidizing velocity in the range of about 0.5 to 5 feet/second (0.15 to 1.5 m/s). Coke at a temperature above the coking temperature, for example, at a temperature from about 100° F. (38° C.) to about 400° F. (204° C.), preferably from about 150° F. (65° C.) to about 350° F. (177° C.), and more preferably from about 150° F. (65° C.) to 250° F. (121), in excess of the actual operating temperature of the coking zone is admitted to reactor 1 by line 17 from heater 2 in an amount sufficient to maintain the coking temperature in the range of about 850° F. (454° C.) to about 1200° F. (650° C.). The pressure in the coking zone is maintained in the range of about 0 to 150 psig (1030 kPag), preferably in the range of about 5 psig (34 kPag) to 45 psig (310 kPag). The lower portion of the coking reactor serves as a stripping zone 5 in which occluded hydrocarbons are removed from the coke by use of a stripping agent, such as steam, as the coke particles move through the stripping zone. A stream of stripped coke is withdrawn from the stripping zone 5 via line 18 and conducted to heater 2. Conversion products of the coking zone are passed through cyclone(s) 20 where entrained solids are removed and returned to coking zone 12 via dipleg 22. The resulting vapors exit cyclone 20 via line 24, and pass into a scrubber 25 mounted at the top of the coking reactor 1. The vapors passed into scrubber 25 are cooled and the heaviest components can be condensed. If desired, a stream of heavy materials condensed in the scrubber may be recycled to the coking reactor via line 26. Coker conversion products are removed from scrubber 25 via line 28 for fractionation in a conventional manner. In heater 2, stripped coke from coking reactor 1 (cold coke) is introduced via line 18 into a fluidized bed of hot coke having an upper level indicated at 30. The bed is heated by passing a fuel gas and/or air into the heater via line 32. The gaseous effluent of the heater, including entrained solids, passes through one or more cyclones which may include first cyclone(s) 34 and second cyclone(s) 36 wherein the separation of the larger entrained solids occur. The separated larger solids are returned to the heater via cyclone diplegs 38. The heated gaseous effluent that contains entrained solids is removed from heater 2 via line 40. Excess coke can be removed from heater 2 via line 42. A portion of hot coke is removed from the fluidized bed in heater 2 and recycled to coking reactor 1 via line 17 to supply heat to the coking zone. Although a gasifier can also be present as part of a coking reaction system, a gasifier is not shown in FIG. 2.

Integration of Coking and Slurry Hydroconversion for Catalyst Recycling

One of the challenges of performing slurry hydroconversion is managing the slurry catalyst. Some types of catalysts for slurry hydroconversion correspond to metal particles (or particles with supported metals) having a size of 5 μm or less. A substantial portion of these small metal particles can be segregated into the slurry hydroconversion pitch product. Thus, even though the pitch is a low value product, effective recovery of the slurry hydroconversion catalyst may require additional processing of the pitch.

In various aspects, the pitch from slurry hydroconversion can be used as part of a feed to a fluidized coker. A first resid or other heavy oil feed can be converted to liquid products using a slurry hydroconversion reaction system. A fluidized coking reaction system can be used to process a second resid or heavy oil feed. The pitch from slurry hydroconversion of the first feed can also be included as part of the feed for the fluidized coking reaction system. During fluidized coking, at least a portion of the metals in the pitch can be included in particles that can be described as "coker fines". These coker fines can then be recycled back to the slurry hydroconversion reaction system for use as at least a portion of the catalyst for slurry hydroconversion.

In addition to allowing for recycle of metal additives, a resid with a sufficiently high metals content can be used to generate coker fines containing metals for use in a slurry hydroconversion reaction system. In this type of configuration, the pitch from the slurry hydroconversion reactor does not need to be introduced into the fluidized coker. Instead, the metals content of a resid (or other heavy oil feed) processed in the fluidized coker is used to generate coker fines that contain metals such as Fe, V, or Ni. These metal-containing coker fines are then used as at least a portion of the catalyst for a slurry hydroconversion reaction system that is processing a second resid (or other heavy oil feed). It is noted that metals already present in a heavy oil feed can also be incorporated into the coker fines when slurry hydroconversion pitch is used as part of feed to a fluidized coker.

Figure 3:
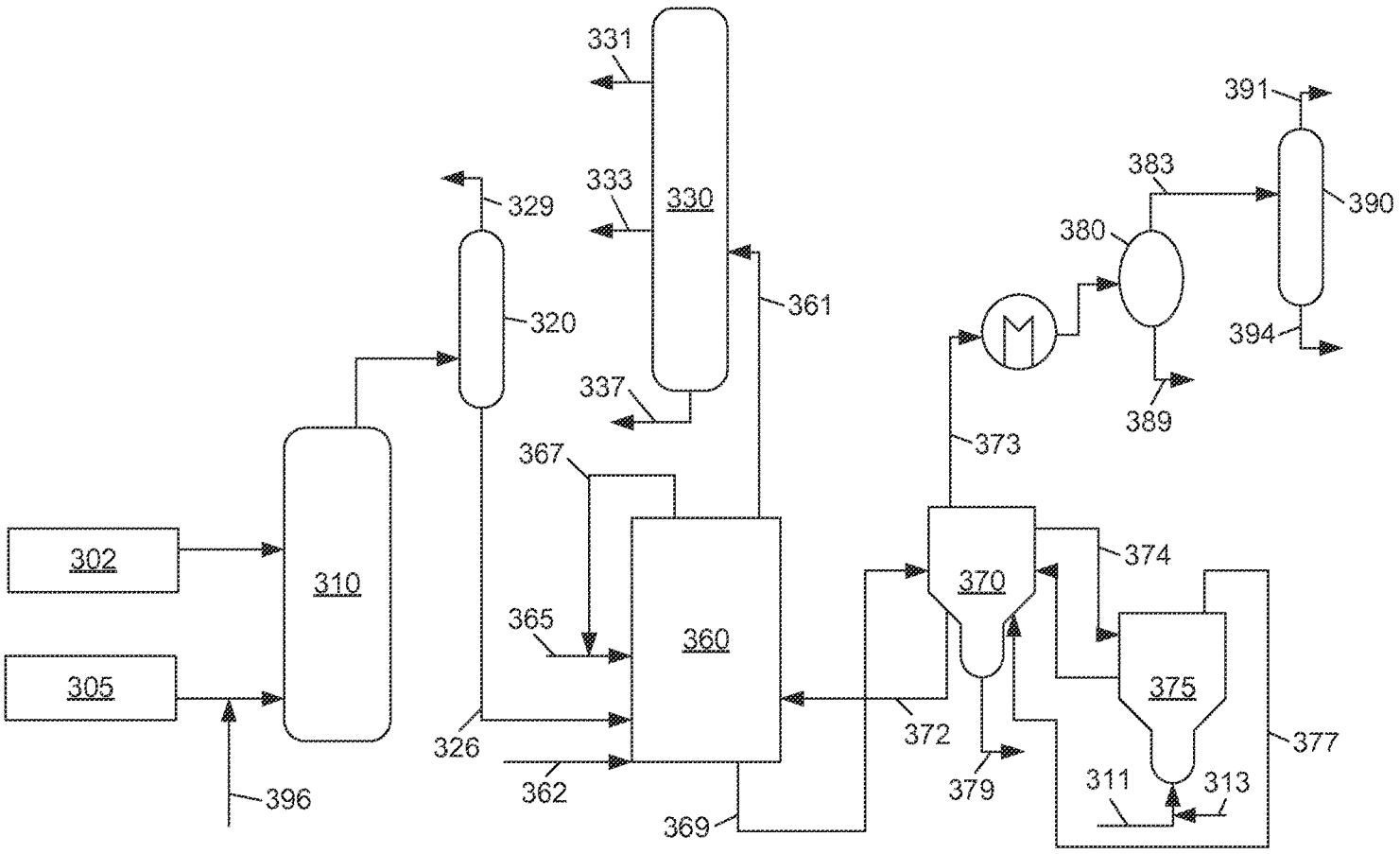
FIG. 3 shows an example of integration of a fluidized coking reaction system with a slurry hydroconversion reaction system.

FIG. 3 shows an example of a reaction system where slurry hydroconversion pitch is used as part of the feed to a fluidized coking reaction system. In FIG. 3, a first vacuum resid (or other heavy oil feed) 305 is passed into slurry hydroconversion reactor 310 along with a hydrogen stream 302. An additive or catalyst 396 can be mixed with heavy oil feed 305 prior to entering slurry hydroconversion reactor 310. At least a portion of additives or catalyst 396 can correspond to particles from coker fines output 394 (recycle loop not explicitly shown). In FIG. 3, the total effluent from slurry hydroconversion reaction system 310 is passed into a separator 320. A fraction including desired liquid products 329 can be sent to a fractionator for forming product fractions.

In the example system shown in FIG. 3, a fraction including the slurry hydroconversion pitch 326 is passed into a fluidized coking reaction system. The fluidized coking reaction system shown in FIG. 3 includes a coking reactor 360, a coker heater 370, and a gasifier 375. Smaller coke particles can be removed from the fluidized coking system via tertiary cyclone 380 and Venturi scrubber 390. During operation, a second resid or heavy oil feed 365 is passed into coking reactor 360 along with steam 312. As noted above, slurry hydroconversion pitch 326 can also optionally be introduced into coking reactor 360. The coking reactor 360 generates a products stream 361 that can be fractionated 330 to form, for example, coker naphtha 331, coker distillates 333, and coker vacuum gas oil 337. An unconverted portion 367 of the feed can be recycled and introduced again into the coking reactor 360.

During fluidized coking, coke particles 372 from heater 370 are passed into coking reactor 360 to provide heat. After coke formation, coke particles 369 are passed to the heater. At least a portion 374 of the coke particles are passed from heater 370 to gasifier 375 in order to generate heat. Steam 313 and air 311 are also introduced into the gasifier 375. Excess coke can be removed from the heater as purge coke 379. Coke particles entrained in the gas flow in the coking reaction system can exit the heater as flow 373. After passing through a heat exchanger for steam generation, the coke particles can be separated out using one or more cycle separator stages 380 followed by at least one scrubber stage 390. The cyclone stages 380 generate fine coke particles 389 and a gas stream 383 containing still smaller coke particles. These smaller coke particles are then separated 390 from the gas stream to form a low BTU gas 391 and coke particles 394 suitable for use as an additive or catalyst for slurry hydroconversion.

Use of Slurry Co-Catalysts for Improved Activity

Catalyst cost is another concern for slurry hydroconversion of heavy oil feeds. Mo-based slurry catalysts generally provide a higher activity than Fe-based slurry catalysts. However, due to the high cost of Mo-Based catalysts, Fe-based slurry catalysts remain a viable alternative. Ferrous sulfate particles are an example of an Fe-based catalyst. $MoS_2$ particles or $MoS_2$ supported on substrate particles are examples of and Mo-based catalyst.

In some aspects, a co-catalyst can be used to provide the activity benefits of an Mo-based catalyst (or more generally a Group VI-based catalyst) while reducing or minimizing the amount of Mo-based catalyst (or Group VI-based catalyst) that is required. This can be accomplished by using both an Fe-based catalyst (or more generally a Group VIII non-noble metal-based catalyst) and an Mo-based catalyst. The ratio of Fe-based catalyst (or Group VIII non-noble metal-based catalyst) to Mo-based catalyst (or Group VI-based catalyst) can be at least about 5:1, such as at least about 8:1, and/or about 25:1 or less, such as about 20:1 or less. Using an Fe-based catalyst as a co-catalyst with an Mo-based catalyst can provide an activity that is greater than the expected activity for the individual catalysts.

Table 1 shows an example of the activity benefits of using a co-catalyst for slurry hydroconversion. The data in Table 1 was generated based on slurry hydroconversion of a resid feed for 180 minutes at a pressure of 2150 psig (14.8 MPag). Hydrogen was provided at 0.36 L/min of $H_2$ as part of a hydrogen stream that contained 6.0 mole % of $H_2S$. The initial reaction temperature was 443° C. The concentrations of catalytic metal in Table 1 refer to the concentrations of the metals themselves, as opposed to the concentrations of the corresponding metal salts.

As shown in Table 1, at the specified reaction conditions, 180 wppm of Mo as a slurry catalyst resulted in 96.5% conversion of the feedstock while creating 3.5 wt % of pitch, coke, and/or other toluene insolubles. As a comparison, use of 1830 wppm of Fe as a catalyst under similar conditions created 7.4 wt % of pitch, coke, and/or other toluene insolubles.

When the Fe-based catalyst is used in conjunction with the Mo-based catalyst, an unexpected benefit in activity is achieved. The first column of Table 1 clearly shows that 1830 wppm of Fe-based catalyst has an inferior activity relative to 180 wppm of the Mo-based catalyst. However, when the Fe-based catalyst and Mo-based catalyst are used together (roughly a 10:1 ratio of Fe to Mo), the amount of toluene insoluble material after complete conversion is reduced to 1.7 wt %. To achieve this level of conversion using only the Mo-based catalyst, the Mo concentration would need to be about 350 wppm. Thus, the presence of the 1830 wppm of Fe in the co-catalyst has the effect of nearly doubling the apparent Mo concentration. However, as shown in the first column of Table 1, the 1830 wppm of Fe in the Fe-based catalyst alone has a significantly lower activity than the 180 wppm of Mo in the Mo-based catalyst.

TABLE 1

Impact of Co-Catalyst on Catalyst Activity

| | Fe alone | Mo alone | Fe + Mo |
|---|---|---|---|
| Fe, wppm | 1830 | 0 | 1830 |
| Mo, wppm | 0 | 180 | 180 |
| Toluene insolubles (coke), wt % | 7.4 | 3.5 | 1.7 |
| Equiv Mo, wppm | 0 | 180 | 350 |
| Fe effectiveness as Mo, wt % | | | 170 |

Based on Table 1, using a combination of Fe- and Mo-based catalysts resulted in a higher activity catalyst than would have been predicted based on the individual catalyst activities. In the single catalyst tests, 1830 wppm of Fe had a substantially lower activity than 180 wppm of Mo. By contrast, when used as co-catalysts, the 1830 wppm of Fe provided additional activity that was comparable to the 180 wppm of Mo. This shows that the catalytic benefits of an elevated Mo-based catalyst concentration during slurry hydroconversion can be achieved at lower Mo concentrations in conjunction with use of an Fe-based catalyst in an appropriate ratio.

In some situations, the promotion of activity for an Fe-based catalyst (or Group VIII non-noble metal-based catalyst) may be dependent on how the Fe-based catalyst is formed relative to the Mo-based catalyst. For example, mixing a pre-formed Fe-based catalyst with a pre-formed Mo-based catalyst may not provide a substantial promotion benefit. By contrast, forming an Mo-based catalyst from a precursor such as phosphomolybdic acid while also forming an Fe-based catalyst from precursor(s) can provide a more significant promotion of activity.

Use of Bulk Metal Catalysts with Hydrotreating Activity

Conventional slurry hydroconversion catalysts are effective for conversion of a heavy oil feed into lower boiling components. However, the resulting conversion products typically still have sulfur and/or nitrogen contents that are not suitable for use as finished products, such as fuel or lubricant products. As a result, the liquid product fractions from slurry hydroconversion are typically hydrotreated, either by hydrotreating a wide cut of the liquid products or by hydrotreating individual products after fractionation. In either case, additional hydroprocessing is required for the slurry hydroconversion products.

In some aspects, a slurry hydroconversion catalyst with increased hydrotreating activity can be used for processing of a heavy oil feed. The bulk catalyst can include at least one Group VIII metal and at least one Group VIB metal. As used herein, the term "bulk", when describing a mixed metal oxide catalyst composition, indicates that the catalyst composition is self-supporting in that it does not require a carrier or support. It is well understood that bulk catalysts may have some minor amount of carrier or support material in their compositions (e.g., about 20 wt % or less, about 15 wt % or less, about 10 wt % or less, about 5 wt % or less, or substantially no carrier or support, based on the total weight of the catalyst composition); for instance, bulk hydroprocessing catalysts may contain a minor amount of a binder, e.g., to improve the physical and/or thermal properties of the catalyst. In contrast, heterogeneous or supported catalyst systems typically comprise a carrier or support onto which one or more catalytically active materials are deposited, often using an impregnation or coating technique. Nevertheless, heterogeneous catalyst systems without a carrier or support (or with a minor amount of carrier or support) are generally referred to as bulk catalysts and are frequently formed by co-precipitation techniques.

The bulk catalyst is wet ball milled before activation so it is well dispersed in the vacuum resid (or other heavy oil feed) under slurry hydrocracking conditions. The bulk catalyst is wet ball milled to a particle size of <5 μm. This reduces or eliminates coke formation under slurry hydrocracking conditions (high 1050+F conversion) because of the high dispersion. A catalyst concentration in the range of about 5 wt % to about 25 wt % of the feed enables high hydrotreating activity in the slurry hydroconversion reactor. As a result, the naphtha and distillate coming from the slurry hydroconversion when using a bulk catalyst have a reduced amount of S and N relative to a conventional slurry hydroconversion process. The slurry hydroconversion products are potentially be suitable for direct product blending, such as having a sulfur content of about 100 wppm or less, or about 50 wppm or less.

In a continuous flow slurry hydrocracker, a bulk catalyst concentration of 5 wt % to 25 wt % can result in a certain hold-up of the catalyst. Preferably the catalyst hold-up in the slurry reactor is 25% of the reactor or more (25-50 wt % range). Given the small particle size of the catalyst (<5 μm) employed in the slurry reactor, there will be entrainment of the bulk metal slurry catalyst in to the products. There will be a good hold-up of the bulk metal catalyst in the slurry hydrocracker because of its high density. The bulk metal catalyst density is 2-3 times larger than the conventional hydrotreating catalysts. Hold-up of the catalyst in the high solids slurry hydrocracker can be monitored through internal sensors (laser, ultrasonic). The entrained bulk metal slurry catalysts can be concentrated in the product VGO stream. Preferably the VGO stream containing the catalyst is recycled to recover and manage the catalyst inventory in this high solids slurry hydrocracker. Even though this is a high solids slurry hydrocracker, space velocity for a reactor can still be characterized based on the volume of feed processed relative to the volume of the reactor.

The entrainment of the bulk metal slurry catalyst depends upon the flow rate of the liquid and gas in to the slurry hydrocracker. Ideally, linear settlement velocity of the solids/bulk metal catalysts (determined by Stokes' law) is greater than the linear liquid velocity in to the slurry hydrocracker to maintain catalyst hold-up in the reactor. But certain entrainment of the bulk metal slurry catalyst in the product stream is preferred since it provides the option to remove part of the deactivated bulk metal slurry catalyst and replenish with fresh catalyst. Fresh bulk metal slurry catalyst can be incorporated in to fresh resid or incorporated into a slide or slip stream. Another option to add bulk metal catalyst continuously to the high pressure high solids slurry hydrocracker is through a catalyst hopper-storage system.

A feed can be exposed to the catalyst in the presence of hydrogen under effective slurry hydroconversion conditions. The amount of catalyst amount can be about 5 wt % to about 25 wt % of the feed. Preferably, a catalyst recycle loop is used to allow for capture and return of catalyst to the slurry hydroconversion reactor. After the slurry hydroconversion reaction, the bulk catalyst is concentrated in a VGO product stream. Although the VGO product stream containing the bulk catalyst is low in S and N, due to the hydrotreating activity of the catalyst, the stream is recycled back to the slurry hydrocracker to recycle the bulk metal catalyst. Recycling of upgraded VGO should result in enhanced conversion of VGO to distillates under slurry hydrocracking conditions thereby providing uplift. During each pass through the recycle loop, a portion of the bulk metal catalyst can be purged as a metals stream, since the catalyst is deactivated by Ni and V metals present in the resid. Catalyst removed as part of a catalyst purge is then replaced by addition of fresh catalyst.

An example of an application for slurry hydroconversion using a bulk metal catalyst is processing of catalyst slurry oil (CSO). CSO is a by-product of VGO cracking in FCC and is rich in 3-ring and 4-ring fused ring aromatics and cannot be cracked further. Co-processing of CSO in a conventional slurry hydrocracker (i.e., without a high concentration of bulk metal catalyst) will not result in significant conversion of CSO, as fused ring aromatics do not crack under slurry hydrocracker thermal conditions. In a conventional slurry hydrocracker, CSO conversion or upgrade by HDS, HDN and HDA is not feasible because of the low activity of Fe or Mo based additives for hydrotreating reactions. Since CSO is rich in 3- and 4-ring fused aromatics, it is a good solvent to prevent the heavy fused-ring aromatics in the resid from phase separating (leads to fouling) at intermediate conversion. The primary value of co-processing CSO with resid in a conventional slurry hydrocracker is to avoid fouling in a conventional slurry hydrocracker.

In contrast, diluting resids with streams such as CSO and processing them in a high solid slurry hydrocracker can provide significant benefits. The high hydrotreating activity of the bulk metal catalyst in the high solid slurry hydrocracker enables conversion of CSO by HDS, HDA and HDN to liquids/distillate range products. Co-processing of CSO with resid in a high solids slurry hydrocracker utilizing a bulk metal catalyst can reduce fouling issues as described in the case above. Additionally, high solids slurry hydrocracker employing a bulk metal catalyst facilitates conversion of disadvantaged feeds such as CSO by HDS, HDN and HDA. These additional activity and reaction benefits of high solids slurry hydroconversion when using a bulk metal catalyst are generally applicable to other types of feeds as well.

Figure 4:
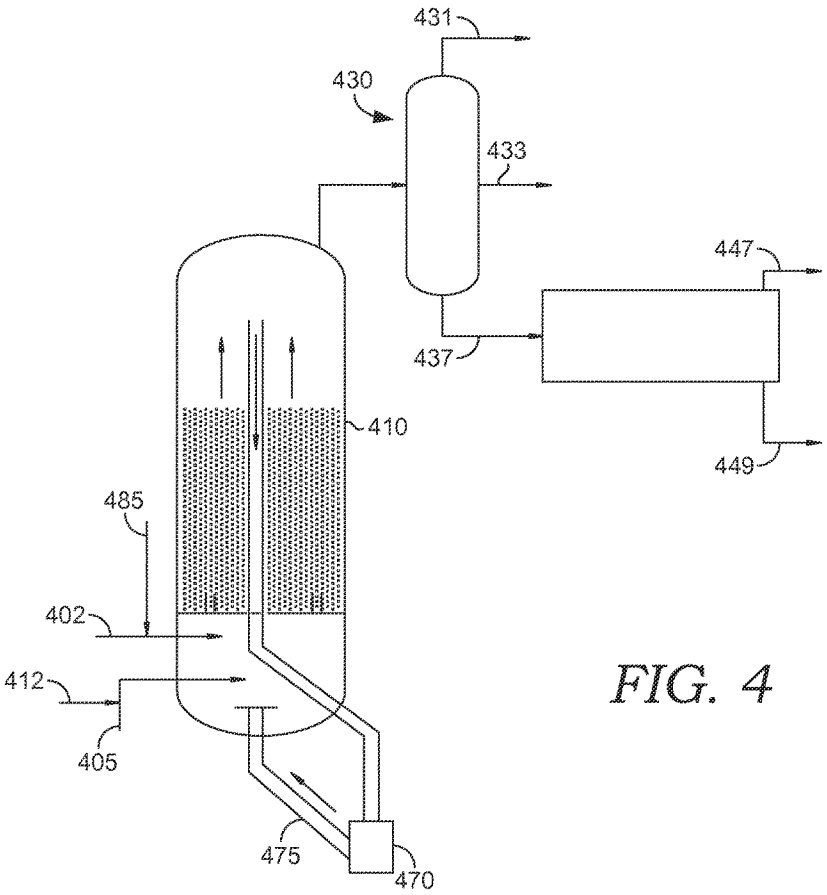
FIGS. 4-6 show examples of slurry hydroconversion reactor configurations.
Figure 5:
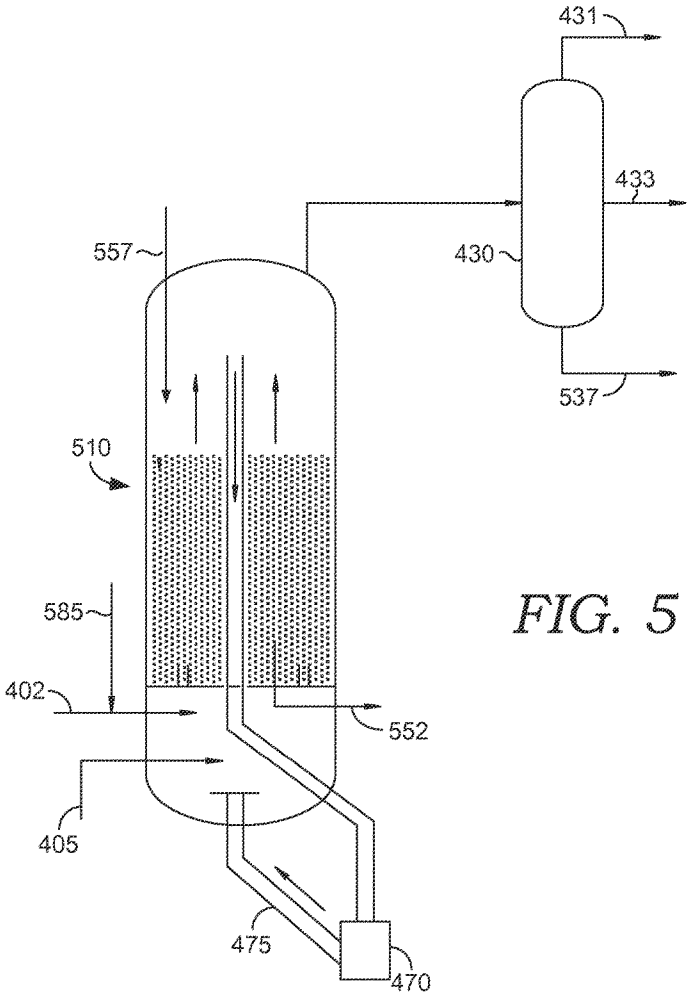
Figure 6:
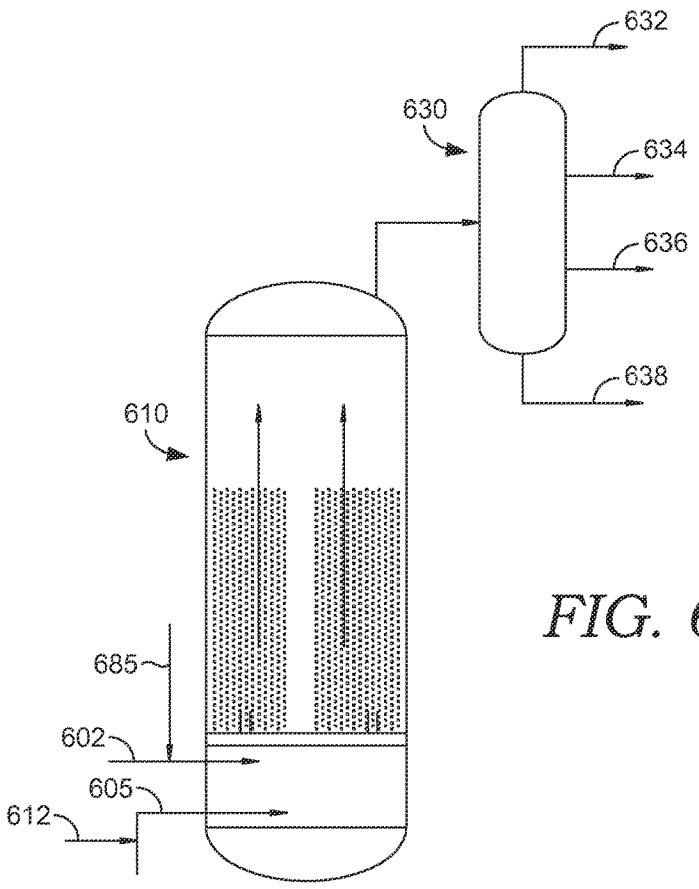

FIGS. 4 and 5 show examples of reaction system configurations for a slurry hydroconversion reactor using a high concentration of bulk metal catalyst. FIG. 6 shows an example of a slurry hydroconversion reactor configuration for a conventional slurry catalyst.

In FIG. 4, a configuration is shown for performing slurry hydroconversion with recycle of a bulk metal catalyst. In FIG. 4, a resid feed 405 is passed into a slurry hydroconversion reactor 410. Fresh or make-up catalyst 412 can be added to feed 405 prior to entering reactor 410. A recycle stream 485 of a vacuum gas oil fraction plus catalyst can also be introduced into the reactor 410. Hydrogen stream 402 for use in the reactor can be combined with recycle stream 485 and/or feed 405 (not shown) prior to entering the reactor. The feed 405 and recycled vacuum gas oil 485 can then be processed in reactor 410 under effective slurry hydroprocessing conditions to generate a slurry hydroprocessing effluent. In the reactor 410, catalyst that is not entrained with the catalyst can separate from the slurry hydroprocessing effluent prior to leaving the reactor. This portion of the catalyst can be recycled 475 to the reactor via a suitable pump, such as an ebullating pump 470. The slurry hydroprocessing effluent that exits from the reactor can be fractionated 430 to form at least a light ends portion 431, a fuels portion 433, and a bottoms fraction including entrained catalyst 437. Because a high activity bulk hydrotreating catalyst is being used, the fuels portion 433 can have a sulfur content and/or a nitrogen content of about 100 wppm or less, such as about 50 wppm or less. The sulfur and nitrogen content of bottoms fraction 437 can also be substantially reduced relative to the initial feed 405. Additionally, it is noted that the bottoms 437 corresponds to a vacuum gas oil and/or resid type fraction. Due to the use of a high activity bulk hydrotreating catalyst, the formation of slurry hydroprocessing pitch is minimized or avoided. A portion of the catalyst in the bottoms fraction 437 can be separated out as a catalyst purge stream 449. The bottoms fraction after separation 449, along with the remaining entrained catalyst, can then be used as recycled vacuum gas oil and catalyst stream 485. It is noted that since the vacuum gas oil fraction is a bottoms fraction, an atmospheric fractionator can be used to perform the separation shown in FIG. 4.

In FIG. 5, an alternative configuration is shown for addition and withdrawal of bulk metal catalyst while reducing or minimizing product recycle. The configuration is similar to FIG. 4 but instead of recycling catalyst as part of a recycled vacuum gas oil, catalyst is retained in the reactor 510 by filtering the slurry hydroconversion effluent as it leaves the reactor 510. In FIG. 5, at least a portion of vacuum gas oil is recycled 585, but the recycled vacuum gas oil does not include catalyst. Instead, the catalyst recycle loop for reactor 510 involves removal or purge 552 of catalyst from the reactor. Catalyst is then reintroduced into the reactor, by addition to the feed 405 (not shown) or by direct introduction 557 to the reactor. The slurry hydroprocessing effluent is handled similarly after leaving the reactor 510, with a fractionator 430 used to form (at least) a light ends fraction 431, a fuels fraction 433, and a bottoms fraction 537. At least a portion of the bottoms fraction 537 can be used to form recycled vacuum gas oil 585.

FIG. 6 shows a configuration for a conventional slurry hydroconversion catalyst along with recycle of vacuum gas oil to the reactor. In FIG. 6, feed 605 is fed into reactor 610. A conventional slurry hydroprocessing catalyst 612, such as an Fe or Mo based catalyst, is added to feed 605. A source of hydrogen 602 and a vacuum gas oil recycle 685 are also added to reactor 610. The effluent from slurry hydroprocessing reactor 610 is then fractionated 630 to form at least a light ends fraction 632, a fuels fraction 634, a vacuum gas oil fraction 636 for at least partial use as recycled vacuum gas oil 685, and a bottoms or pitch fraction 638. The slurry catalyst can be primarily contained in the pitch fraction 638. Because the pitch fraction 638 is formed separately from vacuum gas oil fraction 636, the nature of fractionator 630 can be a vacuum fractionator or another type of separator capable of forming a vacuum resid type fraction.

Trimetallic Catalysts—In some aspects, a suitable catalyst can be a bulk multimetallic catalyst that includes at least one Group VIII non-noble metal and at least two Group VIB metals. The ratio of Group VIB metal to Group VIII non-noble metal is from about 10:1 to about 1:10. In some embodiments, the bulk metal catalyst is represented by the formula: $(X)_b(Mo)_c(W)_dO_z$; wherein X is a non-noble Group VIII metal; the molar ratio of b(c+d) is 0.5/1 to 3/1; the molar ratio of c:d is at least 0.01/1; and z=[2b+6(c+d)]2. Optionally but preferably, the molar ratio of b:(c+d) is 0.75/1 to 1.5/1 and the molar ratio of c:d is 1/10 to 10/1. Performing slurry hydroconversion using such a bulk metal catalyst results in a processed feedstock with reduced levels of both nitrogen and sulfur. The Group VIII non-noble metal can selected from Ni and Co. As an example, when the Group VIII metal is Ni, in some aspects the bulk metal catalyst can have an X-ray diffraction pattern that is essentially amorphous with crystalline peaks at d=2.53 Angstroms and d=1.70 Angstroms.

In some aspects, the bulk metal catalyst can be prepared in situ in the heavy oil feed. For example, a heavy oil feedstock is hydroprocessed in the presence of the bulk multimetallic catalyst prepared by steps that comprise: (a) adding to a hydrocarbon feedstock having a Conradson carbon content up to about 50 weight percent, one or more thermally decomposable metal compound in an amount sufficient to provide the ratio of atoms of feedstock Conradson carbon, calculated as elemental carbon, to atoms of metal constituents of said one or more thermally decomposable metal compounds of less than about 750 to 1, said metal constituent being at least one Group VIII non-noble metal and at least two Group VIB metals; (b) heating said thermally decomposable metal compound within said feedstock at an elevated temperature in the presence of a hydrogen-containing gas to produce a solid high surface area catalyst comprised of at least one Group VIII non-noble metal and at least two Group VIB metals wherein the ratio of Group VIB metal to Group VIII non-noble metal is about 10:1 to about 1:10; and (c) recovering said high surface area catalyst.

To obtain a bulk catalyst composition with high catalytic activity, it is therefore preferred that the metal components, which are at least partly in the solid state during contacting, are porous metal components. It is desired that the total pore volume and pore size distribution of these metal components is approximately the same as those of conventional hydrotreating catalysts. Conventional hydrotreating catalysts generally have a pore volume of 0.05-5 ml/g, preferably of 0.1-4 ml/g, more preferably of 0.1-3 ml/g and most preferably of 0.1-2 ml/g determined by nitrogen adsorption. Pores with a diameter smaller than 1 nm are generally not present in conventional hydrotreating catalysts. Further, conventional hydrotreating catalysts have generally a surface area of to at least 10 $m^2/g$ and more preferably of at least 50 $m^2/g$ and most preferably of at least 100 $m^2/g$, determined via the B.E.T. method. For instance, nickel carbonate can be chosen which has a total pore volume of 0.19-0.39 ml/g and preferably of 0.24-0.35 ml/g determined by nitrogen adsorption and a surface area of 150-400 $m^2/g$ and more preferably of 200-370 $m^2/g$ determined by the B.E.T. method. Furthermore these metal components should have a median particle diameter of at least 50 nm, more preferably at least 100 nm, and preferably not more than 5000 μm and more preferably not more than 3000 μm. After ball milling, the median particle diameter can be about 5 μm or less, such as about 3 μm or less. For instance, by choosing a metal component which is added at least partly in the solid state and which has a large median particle diameter, the other metal components will only react with, the outer layer of the large metal component particle. In this case, so-called "core-shell" structured bulk catalyst particles are obtained.

An appropriate morphology and texture of the metal component can either be achieved by applying suitable preformed metal components or by preparing these metal components by the above-described precipitation under such conditions that a suitable morphology and texture is obtained. A proper selection of appropriate precipitation conditions can be made by routine experimentation.

As has been set out above, to retain the morphology and texture of the metal components which are added at least partly in the solid state, it is essential that the metal of the metal component at least partly remains in the solid state during the whole process of this solid route. It is noted again that it is essential that in no case should the amount of solid metals during the process of the solid route becomes zero. The presence of solid metal comprising particles can easily be detected by visual inspection at least if the diameter of the solid particles in which the metals are comprised is larger than the wavelength of visible light. Of course, methods such as quasi-elastic light scattering (QELS) or near forward scattering which are known to the skilled person can also be used to ensure that in no point in time of the process of the solid route, all metals are in the solute state.

The protic liquid to be applied in the solid or solution route of this invention for preparing catalyst can be any protic liquid. Examples include water, carboxylic acids, and alcohols such as methanol or ethanol. Preferably, a liquid comprising water such as mixtures of an alcohol and water and more preferably water is used as protic liquid in this solid route. Also different protic liquids can be applied simultaneously in the solid route. For instance, it is possible to add a suspension of a metal component in ethanol to an aqueous solution of another metal component.

The Group VIB metal generally comprises chromium, molybdenum, tungsten, or mixtures thereof Suitable Group VIII non-noble metals are, e.g., iron, cobalt, nickel, or mixtures thereof. Preferably, a combination of metal components comprising nickel, molybdenum and tungsten or nickel, cobalt, molybdenum and tungsten is applied in the process of the solid route. If the protic liquid is water, suitable nickel components which are at least partly in the solid state during contacting comprise water-insoluble nickel components such as nickel carbonate, nickel hydroxide, nickel phosphate, nickel phosphite, nickel formate, nickel sulfide, nickel molybdate, nickel tungstate, nickel oxide, nickel alloys such as nickel-molybdenum alloys, Raney nickel, or mixtures thereof. Suitable molybdenum components, which are at least partly in the solid state during contacting, comprise water-insoluble molybdenum components such as molybdenum (di- and tri) oxide, molybdenum carbide, molybdenum nitride, aluminum molybdate, molybdic acid (e.g. $H_2$ $MoO_4$), molybdenum sulfide, or mixtures thereof. Finally, suitable tungsten components which are at least partly in the solid state during contacting comprise tungsten di- and trioxide, tungsten sulfide ($WS_2$ and $WS_3$), tungsten carbide, tungstic acid, tungsten nitride, aluminum tungstate (also meta-, or polytungstate) or mixtures thereof. These components are generally commercially available or can be prepared by, e.g., precipitation. e.g., nickel carbonate can be prepared from a nickel chloride, sulfate, or nitrate solution by adding an appropriate amount of sodium carbonate. It is generally known to the skilled person to choose the precipitation conditions in such a way as to obtain the desired morphology and texture.

In general, metal components, which mainly contain C, O, and/or H besides the metal, are preferred because they are less detrimental to the environment. Nickel carbonate is a preferred metal component to be added at least partly in the solid state because when nickel carbonate is applied, $CO_2$ evolves and positively influences the pH of the reaction mixture. Further, due to the transformation of carbonate into $CO_2$, the carbonate does not end up in the wastewater.

Preferred nickel components which are added in the solute state are water-soluble nickel components, e.g. nickel nitrate, nickel sulfate, nickel acetate, nickel chloride, or mixtures thereof. Preferred molybdenum and tungsten components which are added in the solute state are water-soluble molybdenum and tungsten components such as alkali metal or ammonium molybdate (also peroxo-, di-, tri-, tetra-, hepta-, octa-, or tetradecamolybdate), Mo—P heteropolyanion compounds, Wo—Si heteropolyanion compounds, W—P heteropolyanion compounds, W—Si heteropolyanion compounds, Ni—Mo—W heteropolyanion compounds, Co—Mo—W heteropolyanion compounds, alkali metal or ammonium tungstates (also meta-, para-, hexa-, or polytungstate), or mixtures thereof.

Preferred combinations of metal components are nickel carbonate, tungstic acid and molybdenum oxide. Another preferred combination is nickel carbonate, ammonium dimolybdate and ammonium metatungstate. It is within the scope of the skilled person to select further suitable combinations of metal components. It must be noted that nickel carbonate always comprises a certain amount of hydroxy-groups. It is preferred that the amount of hydroxy-groups present in the nickel carbonate be high.

An alternative method of preparing the catalysts used in the practice of the present invention is to prepare the bulk catalyst composition by a process comprising reacting in a reaction mixture a Group VIII non-noble metal component in solution and a Group VIB metal component in solution to obtain a precipitate. As in the case of the solid route, preferably, one Group VIII non-noble metal component is reacted with two Group VIB metal components. The molar ratio of Group VIB metals to Group VIII non-noble metals applied in the process of the solution route is preferably the same as described for the solid route. Suitable Group VIB and Group VIII non-noble metal components are, e.g., those water-soluble nickel, molybdenum and tungsten components described above for the solid route. Further Group VIII non-noble metal components are, e.g., cobalt or iron components. Further Group VIB metal components are, e.g. chromium components. The metal components can be added to the reaction mixture in solution, suspension or as such. If soluble salts are added as such, they will dissolve in the reaction mixture and subsequently be precipitated. Suitable Group VIB metal salts which are soluble in water are ammonium salts such as ammonium dimolybdate, ammonium tri-, tetra-hepta-, octa-, and tetradeca-molybdate, ammonium para-, meta-, hexa-, and polytungstate, alkali metal salts, silicic acid salts of Group VIB metals such as molybdic silicic acid, molybdic silicic tungstic acid, tungstic acid, metatungstic acid, pertungstic acid, heteropolyanion compounds of Mo—P, Mo—Si, W—P, and W—Si. It is also possible to add Group VIB metal-containing compounds which are not in solution at the time of addition, but where solution is effected in the reaction mixture. Examples of these compounds are metal compounds which contain so much crystal water that upon temperature increase they will dissolve in their own metal water. Further, non-soluble metal salts may be added in suspension or as such, and solution is effected in the reaction mixture. Suitable non-soluble metals salts are heteropolyanion compounds of Co—Mo—W (moderately soluble in cold water), heteropolyanion compounds of Ni—Mo—W (moderately soluble in cold water).

The reaction mixture is reacted to obtain a precipitate. Precipitation is effected by adding a Group VIII non-noble metal salt solution at a temperature and pH at which the Group VIII non-noble metal and the Group VIB metal precipitate, adding a compound which complexes the metals and releases the metals for precipitation upon temperature increase or pH change or adding a Group VIB metal salt solution at a temperature and pH at which the Group VIII non-noble metal and Group VIB metal precipitate, changing the temperature, changing the pH, or lowering the amount of the solvent. The precipitate obtained with this process appears to have high catalytic activity. In contrast to the conventional hydroprocessing catalysts, which usually comprise a carrier impregnated with Group VIII non-noble metals and Group VIB metals, said precipitate can be used without a support. Unsupported catalyst compositions are usually referred to as bulk catalysts. Changing the pH can be done by adding base or acid to the reaction mixture, or adding compounds, which decompose upon temperature, increase into hydroxide ions or $H^+$ ions that respectively increase or decrease the pH. Examples of compounds that decompose upon temperature increase and thereby increase or decrease the pH are urea, nitrites, ammonium cyanate, ammonium hydroxide, and ammonium carbonate.

In an illustrative process according to the solution route, solutions of ammonium salts of a Group VIB metal are made and a solution of a Group VIII non-noble metal nitrate is made. Both solutions are heated to a temperature of approximately 90° C. Ammonium hydroxide is added to the Group VIB metal solution. The Group VIII non-noble metal solution is added to the Group VIB metal solution and direct precipitation of the Group VIB and Group VIII non-noble metal components occurs. This process can also be conducted at lower temperature and/or decreased pressure or higher temperature and/or increased pressure.

In another illustrative process according to the solution route, a Group VIB metal salt, a Group VIII metal salt, and ammonium hydroxide are mixed in solution together and heated so that ammonia is driven off and the pH is lowered to a pH at which precipitation occurs. For instance when nickel, molybdenum, and tungsten components are applied, precipitation typically occurs at a pH below 7.

The bulk catalyst composition can generally be directly shaped into hydroprocessing particles. If the amount of liquid of the bulk catalyst composition is so high that it cannot be directly subjected to a shaping step, a solid liquid separation can be performed before shaping. Optionally the bulk catalyst composition, either as such or after solid liquid separation, can be calcined before shaping.

The median diameter of the bulk catalyst particles is at least 50 nm, more preferably at least 100 nm. For use as a slurry hydroconversion catalyst, the bulk catalyst particles can be ball milled so that the median diameter is less than about 5 μm, such as less than about 3 μm.

If desired, further materials can be added in addition to the metal components already added. These materials include any material that is added during conventional hydroprocessing catalyst preparation. Suitable examples are phosphorus compounds, boron compounds, fluorine-containing compounds, additional transition metals, rare earth metals, fillers, or mixtures thereof.

Suitable additional transition metals are, e.g., rhenium, ruthenium, rhodium, iridium, chromium, vanadium, iron, cobalt, platinum, palladium, cobalt, nickel, molybdenum, or tungsten. Nickel, molybdenum, and tungsten can be applied in the form of any of the water-insoluble nickel, molybdenum and/or tungsten components that are described above for the solid route. These metals can be added at any stage of the process of the present invention prior to the shaping step. Apart from adding these metals during the process of the invention, it is also possible to composite the final catalyst composition therewith. It is, e.g., possible to impregnate the final catalyst composition with an impregnation solution comprising any of these metals.

The processes of the present invention for preparing the bulk catalyst compositions may further comprise a sulfidation step. Sulfidation is generally carried out by contacting the catalyst composition or precursors thereof with a sulfur containing compound such as elementary sulfur, hydrogen sulfide or polysulfides. The sulfidation can generally be carried out subsequently to the preparation of the bulk catalyst composition but prior to the addition of a binder material, and/or subsequently to the addition of the binder material but prior to subjecting the catalyst composition to spray drying and/or any alternative method, and/or subsequently to subjecting the composition to spray drying and/or any alternative method but prior to shaping, and/or subsequently to shaping the catalyst composition. It is preferred that the sulfidation is not carried out prior to any process step that reverts the obtained metal sulfides into their oxides. Such process steps are, e.g., calcination or spray drying or any other high temperature treatment in the presence of oxygen. Consequently, if the catalyst composition is subjected to spray drying and/or any alternative technique, the sulfidation should be carried out subsequent to the application of any of these methods.

Additionally to, or instead of, a sulfidation step, the bulk catalyst composition may be prepared from at least one metal sulfide. If, e.g., the solid route is applied the bulk catalyst component can be prepared form nickel sulfide and/or molybdenum sulfide and/or tungsten sulfide.

Catalyst with Additional Unsaturation—Another aspect described herein relates to a catalyst precursor composition comprising at least one metal from Group 6 of the Periodic Table of the Elements, at least one metal from Groups 8-10 of the Periodic Table of the Elements, and a reaction product formed from (i) a first organic compound containing at least one amine group, or (ii) a second organic compound separate from said first organic compound and containing at least one carboxylic acid group, but not both (i) and (ii). When this reaction product contains additional unsaturation(s) not present in the first or second organic compounds, e.g., from at least partial decomposition/dehydrogenation at conditions including elevated temperatures, the presence of the additional unsaturation(s) in any intermediate or final composition can be determined by methods well known in the art, e.g., by FTIR and/or nuclear magnetic resonance ($^{13}C$ NMR) techniques. This catalyst precursor composition can be a bulk metal catalyst precursor composition or a heterogeneous (supported) metal catalyst precursor composition.

More broadly, this aspect of the present invention relates to a catalyst precursor composition comprising at least one metal from Group 6 of the Periodic Table of the Elements, at least one metal from Groups 8-10 of the Periodic Table of the Elements, and a decomposition/dehydrogenation reaction product formed from at least partial decomposition of (i) a first organic compound containing at least one first functional group or (ii) a second organic compound separate from said first organic compound and containing at least one second functional group, but not both (i) and (ii), which decomposition/dehydrogenation reaction causes an additional unsaturation to form in situ in the reaction product.

When the catalyst precursor is a bulk mixed metal catalyst precursor composition, the reaction product can be obtained by heating the composition (though specifically the first or second organic compounds, or the amine-containing or carboxylic acid-containing compound) to a temperature from about 195° C. to about 250° C. for a time sufficient to effectuate a dehydrogenation, and/or an at least partial decomposition, of the first or second organic compound to form an additional unsaturation in the reaction product in situ. Accordingly, a bulk mixed metal hydroprocessing catalyst composition can be produced from this bulk mixed metal catalyst precursor composition by sulfiding it under sufficient sulfiding conditions, which sulfiding should begin in the presence of the in situ additionally unsaturated reaction product (which may result from at least partial decomposition, e.g., via oxidative dehydrogenation in the presence of oxygen and/or via non-oxidative dehydrogenation in the absence of an appropriate concentration of oxygen, of typically-unfunctionalized organic portions of the first or second organic compounds, e.g., of an aliphatic portion of an organic compound and/or through conjugation/aromatization of unsaturations expanding upon an unsaturated portion of an organic compound).

Catalyst precursor compositions and hydroprocessing catalyst compositions useful in various aspects of the present invention can advantageously comprise (or can have metal components that consist essentially of) at least one metal from Group 6 of the Periodic Table of Elements and at least one metal from Groups 8-10 of the Periodic Table of Elements, and optionally at least one metal from Group 5 of the Periodic Table of Elements. Generally, these metals are present in their substantially fully oxidized form, which can typically take the form of simple metal oxides, but which may be present in a variety of other oxide forms, e.g., such as hydroxides, oxyhydroxides, oxycarbonates, carbonates, oxynitrates, oxysulfates, or the like, or some combination thereof. In one preferred embodiment, the Group 6 metal(s) can be Mo and/or W, and the Group 8-10 metal(s) can be Co and/or Ni. Generally, the atomic ratio of the Group 6 metal(s) to the metal(s) of Groups 8-10 can be from about 2:1 to about 1:3, for example from about 5:4 to about 1:2, from about 5:4 to about 2:3, from about 5:4 to about 3:4, from about 10:9 to about 1:2, from about 10:9 to about 2:3, from about 10:9 to about 3:4, from about 20:19 to about 2:3, or from about 20:19 to about 3:4. When the composition further comprises at least one metal from Group 5, that at least one metal can be V and/or Nb. When present, the amount of Group 5 metal(s) can be such that the atomic ratio of the Group 6 metal(s) to the Group 5 metal(s) can be from about 99:1 to about 1:1, for example from about 99:1 to about 5:1, from about 99:1 to about 10:1, or from about 99:1 to about 20:1. Additionally or alternately, when Group 5 metal(s) is(are) present, the atomic ratio of the sum of the Group 5 metal(s) plus the Group (6) metal(s) compared to the metal(s) of Groups 8-10 can be from about 2:1 to about 1:3, for example from about 5:4 to about 1:2, from about 5:4 to about 2:3, from about 5:4 to about 3:4, from about 10:9 to about 1:2, from about 10:9 to about 2:3, from about 10:9 to about 3:4, from about 20:19 to about 2:3, or from about 20:19 to about 3:4.

As used herein, the numbering scheme for the Periodic Table Groups is as disclosed in *Chemical and Engineering News,* 63(5), 27 (1985).

The metals in the catalyst precursor compositions and in the hydroprocessing catalyst compositions according to the invention can be present in any suitable form prior to sulfiding, but can often be provided as metal oxides. When provided as bulk mixed metal oxides, such bulk oxide components of the catalyst precursor compositions and of the hydroprocessing catalyst compositions according to the invention can be prepared by any suitable method known in the art, but can generally be produced by forming a slurry, typically an aqueous slurry, comprising (1) (a) an oxyanion of the Group 6 metal(s), such as a tungstate and/or a molybdate, or (b) an insoluble (oxide, acid) form of the Group 6 metal(s), such as tungstic acid and/or molybdenum trioxide, (2) a salt of the Group 8-10 metal(s), such as nickel carbonate, and optionally, when present, (3) (a) a salt or oxyanion of a Group 5 metal, such as a vanadate and/or a niobate, or (b) insoluble (oxide, acid) form of a Group 5 metal, such as niobic acid and/or diniobium pentoxide. The slurry can be heated to a suitable temperature, such as from about 60° C. to about 150° C., at a suitable pressure, e.g., at atmospheric or autogenous pressure, for an appropriate time, e.g., about 4 hours to about 24 hours.

Non-limiting examples of suitable mixed metal oxide compositions can include, but are not limited to, nickel-tungsten oxides, cobalt-tungsten oxides, nickel-molybdenum oxides, cobalt-molybdenum oxides, nickel-molybdenum-tungsten oxides, cobalt-molybdenum-tungsten oxides, cobalt-nickel-tungsten oxides, cobalt-nickel-molybdenum oxides, cobalt-nickel-tungsten-molybdenum oxides, nickel-tungsten-niobium oxides, nickel-tungsten-vanadium oxides, cobalt-tungsten-vanadium oxides, cobalt-tungsten-niobium oxides, nickel-molybdenum-niobium oxides, nickel-molybdenum-vanadium oxides, nickel-molybdenum-tungsten-niobium oxides, nickel-molybdenum-tungsten-vanadium oxides, and the like, and combinations thereof.

Suitable mixed metal oxide compositions can advantageously exhibit a specific surface area (as measured via the nitrogen BET method using a Quantachrome Autosorb™ apparatus) of at least about 20 $m^2/g$, for example at least about 30 $m^2/g$, at least about 40 $m^2/g$, at least about 50 $m^2/g$, at least about 60 $m^2/g$, at least about 70 $m^2/g$, or at least about 80 $m^2/g$. Additionally or alternately, the mixed metal oxide compositions can exhibit a specific surface area of not more than about 500 $m^2/g$, for example not more than about 400 $m^2/g$, not more than about 300 $m^2/g$, not more than about 250 $m^2/g$, not more than about 200 $m^2/g$, not more than about 175 $m^2/g$, not more than about 150 $m^2/g$, not more than about 125 $m^2/g$, or not more than about 100 $m^2/g$.

After separating and drying the mixed metal oxide (slurry) composition, it can be treated, generally by impregnation, with (i) an effective amount of a first organic compound containing at least one amine group or (ii) an effective amount of a second organic compound separate from the first organic compound and containing at least one carboxylic acid group, but not both (i) and (ii).

In an embodiment of any of the compositions and/or processes described herein, the first organic compound can comprise at least 10 carbon atoms, for example can comprise from 10 to 20 carbon atoms or can comprise a primary monoamine having from 10 to 30 carbon atoms. Additionally or alternately, the second organic compound can comprise at least 10 carbon atoms, for example can comprise from 10 to 20 carbon atoms or can comprise only one carboxylic acid group and can have from 10 to 30 carbon atoms.

Representative examples of organic compounds containing amine groups can include, but are not limited to, primary and/or secondary, linear, branched, and/or cyclic amines, such as triacontanylamine, octacosanylamine, hexacosanylamine, tetracosanylamine, docosanylamine, erucylamine, eicosanylamine, octadecylamine, oleylamine, linoleylamine, hexadecylamine, sapienylamine, palmitoleylamine, tetradecylamine, myristoleylamine, dodecylamine, decylamine, nonylamine, cyclooctylamine, octylamine, cycloheptylamine, heptylamine, cyclohexylamine, n-hexylamine, isopentylamine, n-pentylamine, t-butylamine, n-butylamine, isopropylamine, n-propylamine, adamantanamine, adamantanemethylamine, pyrrolidine, piperidine, piperazine, imidazole, pyrazole, pyrrole, pyrrolidine, pyrroline, indazole, indole, carbazole, norbornylamine, aniline, pyridylamine, benzylamine, aminotoluene, alanine, arginine, aspartic acid, glutamic acid, glutamine, glycine, histidine, isoleucine, leucine, lysine, phenylalanine, serine, threonine, valine, 1-amino-2-propanol, 2-amino-1-propanol, diaminoeicosane, diaminooctadecane, diaminohexadecane, diaminotetradecane, diaminododecane, diaminodecane, 1,2-diaminocyclohexane, 1,3-diaminocyclohexane, 1,4-diaminocyclohexane, ethylenediamine, ethanolamine, p-phenylenediamine, o-phenylenediamine, m-phenylenediamine, 1,2-propylenediamine, 1,3-propylenediamine, 1,4-diaminobutane, 1,3 diamino-2-propanol, and the like, and combinations thereof. In an embodiment, the molar ratio of the Group 6 metal(s) in the composition to the first organic compound during treatment can be from about 1:1 to about 20:1.

The amine functional group from the first organic compound can include primary or secondary amines, as mentioned above, but generally does not include quaternary amines, and in some instances does not include tertiary amines either. Furthermore, the first organic compound can optionally contain other functional groups besides amines. For instance, the first organic compound can comprise an aminoacid, which possesses an amine functional group and a carboxylic acid functional group simultaneously. Aside from carboxylic acids, other examples of such secondary functional groups in amine-containing organic compounds can generally include, but are not limited to, hydroxyls, aldehydes, anhydrides, ethers, esters, imines, imides, ketones, thiols (mercaptans), thioesters, and the like, and combinations thereof.

Additionally or alternately, the amine portion of the first organic compound can be a part of a larger functional group in that compound, so long as the amine portion (notably the amine nitrogen and the constituents attached thereto) retains its operability as a Lewis base. For instance, the first organic compound can comprise a urea, which functional group comprises an amine portion attached to the carbonyl portion of an amide group. In such an instance, the urea can be considered functionally as an "amine-containing" functional group for the purposes of the present invention herein, except in situations where such inclusion is specifically contradicted. Aside from ureas, other examples of such amine-containing functional groups that may be suitable for satisfying the at least one amine group in the first organic compound can generally include, but are not limited to, hydrazides, sulfonamides, and the like, and combinations thereof.

Representative examples of organic compounds containing carboxylic acids can include, but are not limited to, primary and/or secondary, linear, branched, and/or cyclic amines, such as triacontanoic acid, octacosanoic acid, hexacosanoic acid, tetracosanoic acid, docosanoic acid, erucic acid, docosahexanoic acid, eicosanoic acid, eicosapentanoic acid, arachidonic acid, octadecanoic acid, oleic acid, elaidic acid, stearidonic acid, linoleic acid, alpha-linolenic acid, hexadecanoic acid, sapienic acid, palmitoleic acid, tetradecanoic acid, myristoleic acid, dodecanoic acid, decanoic acid, nonanoic acid, cyclooctanoic acid, octanoic acid, cycloheptanoic acid, heptanoic acid, cyclohexanoic acid, hexanoic acid, adamantanecarboxylic acid, norbornaneacetic acid, benzoic acid, salicylic acid, acetylsalicylic acid, citric acid, maleic acid, malonic acid, glutaric acid, lactic acid, oxalic acid, tartaric acid, cinnamic acid, vanillic acid, succinic acid, adipic acid, phthalic acid, isophthalic acid, terephthalic acid, ethylenediaminetetracarboxylic acids (such as EDTA), fumaric acid, alanine, arginine, aspartic acid, glutamic acid, glutamine, glycine, histidine, isoleucine, leucine, lysine, phenylalanine, serine, threonine, valine, 1,2-cyclohexanedicarboxylic acid, 1,3-cyclohexanedicarboxylic acid, 1,4-cyclohexanedicarboxylic acid, and the like, and combinations thereof. In an embodiment, the molar ratio of the Group 6 metal(s) in the composition to the second organic compound during treatment can be from about 3:1 to about 20:1.

The second organic compound can optionally contain other functional groups besides carboxylic acids. For instance, the second organic compound can comprise an aminoacid, which possesses a carboxylic acid functional group and an amine functional group simultaneously. Aside from amines, other examples of such secondary functional groups in carboxylic acid-containing organic compounds can generally include, but are not limited to, hydroxyls, aldehydes, anhydrides, ethers, esters, imines, imides, ketones, thiols (mercaptans), thioesters, and the like, and combinations thereof. In some embodiments, the second organic compound can contain no additional amine or alcohol functional groups in addition to the carboxylic acid functional group(s).

Additionally or alternately, the reactive portion of the second organic compound can be a part of a larger functional group in that compound and/or can be a derivative of a carboxylic acid that behaves similarly enough to a carboxylic acid, such that the reactive portion and/or derivative retains its operability as a Lewis acid. One example of a carboxylic acid derivative can include an alkyl carboxylate ester, where the alkyl group does not substantially hinder (over a reasonable time scale) the Lewis acid functionality of the carboxylate portion of the functional group.

In certain embodiments, the organic compound(s)/additive(s) and/or the reaction product(s) are not located/incorporated within the crystal lattice of the mixed metal oxide precursor composition, e.g., instead being located on the surface and/or within the pore volume of the precursor composition and/or being associated with (bound to) one or more metals or oxides of metals in a manner that does not significantly affect the crystalline lattice of the mixed metal oxide precursor composition, as observed through XRD and/or other crystallographic spectra. It is noted that, in these certain embodiments, a sulfided version of the mixed metal oxide precursor composition can still have its sulfided form affected by the organic compound(s)/additive(s) and/or the reaction product(s), even though the oxide lattice is not significantly affected.

One way to attain a catalyst precursor composition containing a decomposition/dehydrogenation reaction product, such as one containing additional unsaturations, includes: (a) treating a catalyst precursor composition, which comprises at least one metal from Group 6 of the Periodic Table of the Elements and at least one metal from Groups 8-10 of the Periodic Table of the Elements, with a first organic compound containing at least one amine group or a second organic compound separate from said first organic compound and containing at least one carboxylic acid group, but not both, to form an organically treated precursor catalyst composition; and (b) heating the organically treated precursor catalyst composition at a temperature sufficient and for a time sufficient for the first or second organic compounds to react to form an in situ product containing additional unsaturation (for example, depending upon the nature of the first or second organic compound, the temperature can be from about 195° C. to about 250° C., such as from about 200° C. to about 230° C.), thereby forming the additionally-unsaturated catalyst precursor composition.

In certain advantageous embodiments, the heating step (b) above can be conducted for a sufficiently long time so as to form additional unsaturation(s), which may result from at least partial decomposition (e.g., oxidative and/or non-oxidative dehydrogenation and/or aromatization) of some (typically-unfunctionalized organic) portions of the first or second organic compounds, but generally not for so long that the at least partial decomposition volatilizes more than 50% by weight of the first or second organic compounds. Without being bound by theory, it is believed that additional unsaturation(s) formed in situ and present at the point of sulfiding the catalyst precursor composition to form a sulfided (hydroprocessing) catalyst composition can somehow assist in controlling one or more of the following: the size of sulfided crystallites; the coordination of one or more of the metals during sulfidation, such that a higher proportion of the one or more types of metals are in appropriate sites for promoting desired hydroprocessing reactions (such as hydrotreating, hydrodenitrogenation, hydrodesulfurization, hydrodeoxygenation, hydrodemetallation, hydrocracking including selective hydrocracking, hydroisomerization, hydrodewaxing, and the like, and combinations thereof, and/or for reducing/minimizing undesired hydroprocessing reactions, such as aromatic saturation, hydrogenation of double bonds, and the like, and combinations thereof) than for sulfided catalysts made in the absence of the in situ formed reaction product having additional unsaturation(s); and coordination/catalysis involving one or more of the metals after sulfidation, such that a higher proportion (or each) of the one or more types of metals are more efficient at promoting desired hydroprocessing reactions (e.g., because the higher proportion of metal sites can catalyze more hydrodesulfurization reactions of the same type in a given timescale and/or because the higher proportion of the metal sites can catalyze more difficult hydrodesulfurization reactions in a similar timescale) than for sulfided catalysts made in the absence of the in situ formed reaction product having additional unsaturation(s).

When used to make a bulk mixed metal catalyst precursor composition, the in situ reacted catalyst precursor composition can, in one embodiment, consist essentially of the reaction product, an oxide form of the at least one metal from Group 6, an oxide form of the at least one metal from Groups 8-10, and optionally about 20 wt % or less of a binder (e.g., about 10 wt % or less).

After treatment of the catalyst precursor containing the at least one Group 6 metal and the at least one Group 8-10 metal with the first or second organic compounds, the organically treated catalyst precursor composition can be heated to a temperature high enough to form the reaction product and optionally but preferably high enough to enable any dehydrogenation/decomposition byproduct to be easily removed (e.g., in order to drive the reaction equilibrium to the at least partially dehydrogenated/decomposed product). Additionally or alternately, the organically treated catalyst precursor composition can be heated to a temperature low enough so as to substantially retain the reaction product (containing the additional unsaturations), so as not to significantly decompose the reaction product, and/or so as not to significantly volatilize (more than 50% by weight of) the first or second organic compounds (whether reacted or not).

It is contemplated that the specific lower and upper temperature limits based on the above considerations can be highly dependent upon a variety of factors that can include, but are not limited to, the atmosphere under which the heating is conducted, the chemical and/or physical properties of the first organic compound, the second organic compound, the reaction product, and/or any reaction byproduct, or a combination thereof. In one embodiment, the heating temperature can be at least about 120° C., for example at least about 150° C., at least about 165° C., at least about 175° C., at least about 185° C., at least about 195° C., at least about 200° C., at least about 210° C., at least about 220° C., at least about 230° C., at least about 240° C., or at least about 250° C. Additionally or alternately, the heating temperature can be not greater than about 400° C., for example not greater than about 375° C., not greater than about 350° C., not greater than about 325° C., not greater than about 300° C., not greater than about 275° C., not greater than about 250° C., not greater than about 240° C., not greater than about 230° C., not greater than about 220° C., not greater than about 210° C., or not greater than about 200° C.

In one embodiment, the heating can be conducted in a low- or non-oxidizing atmosphere (and conveniently in an inert atmosphere, such as nitrogen). In an alternate embodiment, the heating can be conducted in a moderately- or highly-oxidizing environment. In another alternate embodiment, the heating can include a multi-step process in which one or more heating steps can be conducted in the low- or non-oxidizing atmosphere, in which one or more heating steps can be conducted in the moderately- or highly-oxidizing environment, or both. Of course, the period of time for the heating in the environment can be tailored to the first or second organic compound, but can typically extend from about 5 minutes to about 168 hours, for example from about 10 minutes to about 96 hours, from about 10 minutes to about 48 hours, from about 10 minutes to about 24 hours, from about 10 minutes to about 18 hours, from about 10 minutes to about 12 hours, from about 10 minutes to about 8 hours, from about 10 minutes to about 6 hours, from about 10 minutes to about 4 hours, from about 20 minutes to about 96 hours, from about 20 minutes to about 48 hours, from about 20 minutes to about 24 hours, from about 20 minutes to about 18 hours, from about 20 minutes to about 12 hours, from about 20 minutes to about 8 hours, from about 20 minutes to about 6 hours, from about 20 minutes to about 4 hours, from about 30 minutes to about 96 hours, from about 30 minutes to about 48 hours, from about 30 minutes to about 24 hours, from about 30 minutes to about 18 hours, from about 30 minutes to about 12 hours, from about 30 minutes to about 8 hours, from about 30 minutes to about 6 hours, from about 30 minutes to about 4 hours, from about 45 minutes to about 96 hours, from about 45 minutes to about 48 hours, from about 45 minutes to about 24 hours, from about 45 minutes to about 18 hours, from about 45 minutes to about 12 hours, from about 45 minutes to about 8 hours, from about 45 minutes to about 6 hours, from about 45 minutes to about 4 hours, from about 1 hour to about 96 hours, from about 1 hour to about 48 hours, from about 1 hour to about 24 hours, from about 1 hour to about 18 hours, from about 1 hour to about 12 hours, from about 1 hour to about 8 hours, from 1 hour minutes to about 6 hours, or from about 1 hour to about 4 hours.

In an embodiment, the organically treated catalyst precursor composition and/or the catalyst precursor composition containing the reaction product can contain from about 4 wt % to about 20 wt %, for example from about 5 wt % to about 15 wt %, carbon resulting from the first and second organic compounds and/or from the condensation product, as applicable, based on the total weight of the relevant composition.

Additionally or alternately, as a result of the heating step, the reaction product from the organically treated catalyst precursor can exhibit a content of unsaturated carbon atoms (which includes aromatic carbon atoms), as measured according to peak area comparisons using $^{13}C$ NMR techniques, of at least 29%, for example at least about 30%, at least about 31%, at least about 32%, or at least about 33%. Further additionally or alternately, the reaction product from the organically treated catalyst precursor can optionally exhibit a content of unsaturated carbon atoms (which includes aromatic carbon atoms), as measured according to peak area comparisons using $^{13}C$ NMR techniques, of up to about 70%, for example up to about 65%, up to about 60%, up to about 55%, up to about 50%, up to about 45%, up to about 40%, or up to about 35%. Still further additionally or alternately, as a result of the heating step, the reaction product from the organically treated catalyst precursor can exhibit an increase in content of unsaturated carbon atoms (which includes aromatic carbon atoms), as measured according to peak area comparisons using $^{13}C$ NMR techniques, of at least about 17%, for example at least about 18%, at least about 19%, at least about 20%, or at least about 21% (e.g., in an embodiment where the first organic compound is oleylamine and the second organic compound is oleic acid, such that the combined unsaturation level of the unreacted compounds is about 11.1% of carbon atoms, a ~17% increase in unsaturated carbons upon heating corresponds to about 28.1% content of unsaturated carbon atoms in the reaction product). Yet further additionally or alternately, the reaction product from the organically treated catalyst precursor can optionally exhibit an increase in content of unsaturated carbon atoms (which includes aromatic carbon atoms), as measured according to peak area comparisons using $^{13}C$ NMR techniques, of up to about 60%, for example up to about 55%, up to about 50%, up to about 45%, up to about 40%, up to about 35%, up to about 30%, or up to about 25%.

Again further additionally or alternately, as a result of the heating step, the reaction product from the organically treated catalyst precursor can exhibit a ratio of unsaturated carbon atoms to aromatic carbon atoms, as measured according to peak area ratios using infrared spectroscopic techniques of a deconvoluted peak centered from about 1700 $cm^{-1}$ to about 1730 $cm^{-1}$ (e.g., at about 1715 $cm^{-1}$), compared to a deconvoluted peak centered from about 1380 $cm^{-1}$ to about 1450 $cm^{-1}$ (e.g., from about 1395 $cm^{-1}$ to about 1415 $cm^{-1}$), of at least 0.9, for example at least 1.0, at least 1.1, at least 1.2, at least 1.3, at least 1.4, at least 1.5, at least 1.7, at least 2.0, at least 2.2, at least 2.5, at least 2.7, or at least 3.0. Again still further additionally or alternately, the reaction product from the organically treated catalyst precursor can exhibit a ratio of unsaturated carbon atoms to aromatic carbon atoms, as measured according to peak area ratios using infrared spectroscopic techniques of a deconvoluted peak centered from about 1700 $cm^{-1}$ to about 1730 $cm^{-1}$ (e.g., at about 1715 $cm^{-1}$), compared to a deconvoluted peak centered from about 1380 $cm^{-1}$ to about 1450 $cm^{-1}$ (e.g., from about 1395 $cm^{-1}$ to about 1415 $cm^{-1}$), of up to 15, for example up to 10, up to 8.0, up to 7.0, up to 6.0, up to 5.0, up to 4.5, up to 4.0, up to 3.5, or up to 3.0.

A (sulfided) hydroprocessing catalyst composition can then be produced by sulfiding the catalyst precursor composition containing the reaction product. Sulfiding is generally carried out by contacting the catalyst precursor composition containing the reaction product with a sulfur-containing compound (e.g., elemental sulfur, hydrogen sulfide, polysulfides, or the like, or a combination thereof, which may originate from a fossil/mineral oil stream, from a biocomponent-based oil stream, from a combination thereof, or from a sulfur-containing stream separate from the aforementioned oil stream(s)) at a temperature and for a time sufficient to substantially sulfide the composition and/or sufficient to render the sulfided composition active as a hydroprocessing catalyst. For instance, the sulfidation can be carried out at a temperature from about 300° C. to about 400° C., e.g., from about 310° C. to about 350° C., for a period of time from about 30 minutes to about 96 hours, e.g., from about 1 hour to about 48 hours or from about 4 hours to about 24 hours. The sulfiding can generally be conducted before or after combining the metal (oxide) containing composition with a binder, if desired, and before or after forming the composition into a shaped catalyst. The sulfiding can additionally or alternately be conducted in situ in a hydroprocessing reactor. Obviously, to the extent that a reaction product of the first or second organic compounds contains additional unsaturations formed in situ, it would generally be desirable for the sulfidation (and/or any catalyst treatment after the organic treatment) to significantly maintain the in situ formed additional unsaturations of said reaction product.

The sulfided catalyst composition can exhibit a layered structure comprising a plurality of stacked $YS_2$ layers, where Y is the Group 6 metal(s), such that the average number of stacks (typically for bulk organically treated catalysts) can be from about 1.5 to about 3.5, for example from about 1.5 to about 3.0, from about 2.0 to about 3.3, from about 2.0 to about 3.0, or from about 2.1 to about 2.8. For instance, the treatment of the metal (oxide) containing precursor composition according to the invention can afford a decrease in the average number of stacks of the treated precursor of at least about 0.8, for example at least about 1.0, at least about 1.2, at least about 1.3, at least about 1.4, or at least about 1.5, as compared to an untreated metal (oxide) containing precursor composition. As such, the number of stacks can be considerably less than that obtained with an equivalent sulfided mixed metal (oxide) containing precursor composition produced without the first or second organic compound treatment. The reduction in the average number of stacks can be evidenced, e.g., via X-ray diffraction spectra of relevant sulfided compositions, in which the (002) peak appears significantly broader (as determined by the same width at the half-height of the peak) than the corresponding peak in the spectrum of the sulfided mixed metal (oxide) containing precursor composition produced without the organic treatment (and/or, in certain cases, with only a single organic compound treatment using an organic compound having less than 10 carbon atoms) according to the present invention. Additionally or alternately to X-ray diffraction, transmission electron microscopy (TEM) can be used to obtain micrographs of relevant sulfided compositions, including multiple microcrystals, within which micrograph images the multiple microcrystals can be visually analyzed for the number of stacks in each, which can then be averaged over the micrograph visual field to obtain an average number of stacks that can evidence a reduction in average number of stacks compared to a sulfided mixed metal (oxide) containing precursor composition produced without the organic treatment (and/or, in certain cases, with only a single organic compound treatment) according to the present invention.

If a binder material is used in the preparation of the catalyst composition it can be any material that is conventionally applied as a binder in hydroprocessing catalysts. Examples include silica, silica-alumina, such as conventional silica-alumina, silica-coated alumina and alumina-coated silica, alumina such as (pseudo) boehmite, or gibbsite, titania, zirconia, cationic clays or anionic clays such as saponite, bentonite, kaoline, sepiolite or hydrotalcite, or mixtures thereof. Preferred binders are silica, silica-alumina, alumina, titanic, zirconia, or mixtures thereof. These binders may be applied as such or after peptization. It is also possible to apply precursors of these binders that, during the process of the invention are converted into any of the above-described binders. Suitable precursors are, e.g., alkali metal aluminates (to obtain an alumina binder), water glass (to obtain a silica binder), a mixture of alkali metal aluminates and water glass (to obtain a silica alumina binder), a mixture of sources of a di-, tri-, and/or tetravalent metal such as a mixture of water-soluble salts of magnesium, aluminum and/or silicon (to prepare a cationic clay and/or anionic clay), chlorohydrol, aluminum sulfate, or mixtures thereof.

If desired, the binder material may be composited with a Group VIB metal and/or a Group VIII non-noble metal, prior to being composited with the bulk catalyst composition and/or prior to being added during the preparation thereof. Compositing the binder material with any of these metals may be carried out by impregnation of the solid binder with these materials. The person skilled in the art knows suitable impregnation techniques. If the binder is peptized, it is also possible to carry out the peptization in the presence of Group VIB and/or Group VIII non-noble metal components.

If alumina is applied as binder, the surface area preferably lies in the range of 100-400 $m^2/g$, and more preferably 150-350 $m^2/g$, measured by the B.E.T. method. The pore volume of the alumina is preferably in the range of 0.5-1.5 ml/g measured by nitrogen adsorption.

Generally, the binder material to be added in the process of the invention has less catalytic activity than the bulk catalyst composition or no catalytic activity at all. Consequently, by adding a binder material, the activity of the bulk catalyst composition may be reduced. Therefore, the amount of binder material to be added in the process of the invention generally depends on the desired activity of the final catalyst composition. Binder amounts from 0-95 wt. % of the total composition can be suitable, depending on the envisaged catalytic application. However, to take advantage of the resulting unusual high activity of the composition of the present invention, binder amounts to be added are generally in the range of 0.5-75 wt. % of the total composition.

The catalyst composition can be directly shaped. Shaping comprises extrusion, pelletizing, beading, and/or spray drying. It must be noted that if the catalyst composition is to be applied in slurry type reactors, fluidized beds, moving beds, expanded beds, or ebullating beds, spray drying or beading is generally applied for fixed bed applications, although other methods such as extruding, pelletizing and/or beading can be used. In the latter case, prior to or during the shaping step, any additives that are conventionally used to facilitate shaping can be added. These additives may comprise aluminum stearate, surfactants, graphite or mixtures thereof. These additives can be added at any stage prior to the shaping step. Further, when alumina is used as a binder, it may be desirable to add acids prior to the shaping step such as nitric acid to increase the mechanical strength of the extrudates.

It is preferred that a binder material is added prior to the shaping step. Further, it is preferred that the shaping step is carried out in the presence of a liquid, such as water. Preferably, the amount of liquid in the extrusion mixture, expressed as LOI is in the range of 20-80%.

The resulting shaped catalyst composition can, after an optional drying step, be optionally calcined. Calcination however is not essential to the process of the invention. If a calcination is carried out in the process of the invention, it can be done at a temperature of, e.g., from 100° C. to 600° C. and preferably 350° C. to 500° C. for a time varying from 0.5 to 48 hours. The drying of the shaped particles is generally carried out at temperatures above 100° C.

In a preferred embodiment of the invention, the catalyst composition is subjected to spray drying, (flash) drying, milling, kneading, or combinations thereof prior to shaping. These additional process steps can be conducted either before or after a binder is added, after solid-liquid separation, before or after calcination and subsequent to re-wetting. It is believed that by applying any of the above-described techniques of spray drying, (flash) drying, milling, kneading, or combinations thereof, the degree of mixing between the bulk catalyst composition and the binder material is improved. This applies to both cases where the binder material is added before or after the application of any of the above-described methods. However, it is generally preferred to add the binder material prior to spray drying and/or any alternative technique. If the binder is added subsequent to spray drying and/or any alternative technique, the resulting composition is preferably thoroughly mixed by any conventional technique prior to shaping. An advantage of, e.g., spray drying is that no wastewater streams are obtained when this technique is applied.

Furthermore, a cracking component may be added during catalyst preparation. A cracking component in the sense of the present invention is any conventional cracking component such as cationic clays, anionic clays, zeolites such as ZSM-5, (ultra-stable) zeolite Y, zeolite X, ALPO's, SAPO's, amorphous cracking components such as silica-alumina, or mixtures thereof. It will be clear that some materials may act as a binder and a cracking component at the same time. For instance, silica-alumina may have at the same time a cracking and a binding function.

If desired, the cracking component may be composited with a Group VIB metal and/or a Group VII non-noble metal prior to being composited with the bulk catalyst composition and/or prior to being added during the preparation thereof. Compositing the cracking component with any of these metals may be carried out by impregnation of the cracking component with these materials.

The cracking component, which can comprise about 0-80 wt. %, based on the total weight of the catalyst, can be added at any stage of the process of the present invention prior to the shaping step. However, it is preferred to add the cracking component during the compositing step (ii) with the binder.

Generally, it depends on the envisaged catalytic application of the final catalyst composition which of the above-described cracking components is added. A zeolite is preferably added if the resulting composition shall be applied in hydrocracking or fluid catalytic cracking. Other cracking components such as silica-alumina or cationic clays are preferably added if the final catalyst composition shall be used in hydrotreating applications. The amount of cracking material that is added depends on the desired activity of the final composition and the application envisaged and thus may vary from 0-80 wt. %, based on the total weight of the catalyst composition.

ADDITIONAL EMBODIMENTS

Embodiment 1

A method for processing a heavy oil feedstock, comprising: providing a first heavy oil feedstock having a 10% distillation point of at least about 650° F. and a first Conradson carbon residue wt %; providing a second heavy oil feedstock having an initial boiling point of at least about 650° F. and a second Conradson carbon residue wt %; coking the first heavy oil feedstock under effective fluidized coking conditions to form at least a first plurality of liquid products and coke, the coke comprising coker fines containing at least one of Ni, V, or Fe; and exposing the second heavy oil feedstock to at least a portion of the coker fines under effective slurry hydroconversion conditions to form at least a second plurality of liquid products, the effective slurry hydroconversion conditions being effective for conversion of at least about 80 wt % of the second heavy oil feedstock relative to a conversion temperature, such as at least about 90 wt %.

Embodiment 2

The method of Embodiment 1, wherein the second Conradson carbon residue wt % is at least 5 wt % greater than the first Conradson carbon residue wt %.

Embodiment 3

The method of any of the above embodiments, wherein the Conradson carbon residue wt % of the first heavy oil feedstock is at least about 5 wt %, concentration of Ni, Fe, and/or V is at least about 50 wppm, or a combination thereof.

Embodiment 4

The method of any of the above embodiments, wherein the Conradson carbon residue wt % of the second heavy oil feedstock is at least about 5 wt %, concentration of Ni, Fe, and/or V is at least about 50 wppm, or a combination thereof.

Embodiment 5

The method of any of the above embodiments, wherein exposing the second heavy oil feedstock to at least a portion of the coker fines comprises exposing the second heavy oil feedstock to a catalyst and the at least a portion of the coker fines.

Embodiment 6

The method of Embodiment 5, wherein the catalyst comprises Mo, Fe, or a combination thereof.

Embodiment 7

The method of any of the above embodiments, wherein exposing the second heavy oil feedstock to at least a portion of the coker fines further forms slurry hydroconversion pitch, the method further comprising coking the slurry hydroconversion pitch under the effective fluidized coking conditions.

Embodiment 8

The method of any of the above embodiments, wherein a 10% distillation point of the first heavy oil feedstock is at least about 900° F.

Embodiment 9

The method of any of the above embodiments, wherein the first heavy oil has a Conradson carbon residue of greater than 5 wt %.

Embodiment 10

The method of any of the above embodiments, wherein the second heavy oil has a Conradson carbon residue of less than about 30 wt %.

Embodiment 11

A method for processing a heavy oil feedstock, comprising: providing a heavy oil feedstock having a 10% distillation point of at least about 650° F. and a first Conradson carbon residue wt %; and exposing the heavy oil feedstock to a plurality of slurry hydroconversion catalysts under effective slurry hydroconversion conditions to form at least a second plurality of liquid products, the effective slurry hydroconversion conditions being effective for conversion of at least about 80 wt % of the second heavy oil feedstock relative to a conversion temperature, such as at least about 90 wt %, wherein the plurality of slurry hydroconversion catalysts comprise a first catalyst comprising a Group VI metal and a second catalyst comprising a non-noble Group VIII metal, a ratio of the non-noble Group VIII metal to the Group VI metal being from about 5:1 to about 25:1.

Embodiment 12

The method of Embodiment 11, wherein the catalyst comprises Mo, Fe, or a combination thereof.

Embodiment 13

The method of embodiments 11 or 12, further comprising separating the plurality of liquid products using one or more separators, wherein a first separator of the one or more separators separates a slurry hydroconversion effluent to form the second plurality of liquid products and a product comprising slurry hydroconversion pitch, wherein at least a portion of the product comprising slurry hydroconversion pitch is recycled for exposure to the plurality of slurry hydroconversion catalysts under the effective slurry hydroconversion conditions.

Embodiment 14

A method for processing a heavy oil feedstock, comprising: providing a heavy oil feedstock having a 10% distillation point of at least about 650° F. and a first Conradson carbon residue wt %; exposing the heavy oil feedstock to a slurry hydroconversion catalyst in a reactor under effective slurry hydroconversion conditions to form at least a plurality of liquid products, the effective slurry hydroconversion conditions being effective for conversion of at least about 80 wt % of the second heavy oil feedstock relative to a conversion temperature, such as at least about 90 wt %; separating a vacuum gas oil product from the plurality of liquid products, the vacuum gas oil product further comprising at least a portion of the slurry hydroconversion catalyst; and recycling the vacuum gas oil product to the reactor, wherein the slurry hydroconversion catalyst is a bulk multimetallic catalyst comprising at least one non-noble Group VIII (Group 8-10) metal and at least one Group VIB (Group 6) metal, a weight of the slurry hydroconversion catalyst being about 5 wt % to 25 wt % of a weight of the heavy oil feedstock.

Embodiment 15

The method of Embodiment 14, wherein the slurry hydroconversion catalyst is a bulk multimetallic catalyst comprising at least one non-noble Group VIII metal and at least two Group VIB metals, a ratio of the non-noble Group VIII metal to the Group VIB metals being from about 10:1 to about 1:10, the slurry hydroconversion catalyst being about 5 wt % to 25 wt % of the heavy oil feedstock.

Embodiment 16

The method of embodiment 15, wherein the bulk multimetallic catalyst is represented by the formula $(X)_b(Mo)_c$ $(W)_dO_z$ wherein X is a Group VIII non-noble metal, the Group VIII non-noble metal preferably being at least one of Ni and Co.

Embodiment 17

The method of embodiments 15 or 16, wherein a ratio of b:(c+d) is from 0.5:1 to 3:1, preferably 0.75:1 to 1.5:1.

Embodiment 18

The method of embodiment 14, wherein the bulk catalyst is formed from a catalyst precursor that comprises at least one metal from Group 6 of the Periodic Table of the Elements, at least one metal from Groups 8-10 of the Periodic Table of the Elements, and a reaction product formed from (i) a first organic compound containing at least one amine group and at least 10 carbons or (ii) a second organic compound containing at least one carboxylic acid group and at least 10 carbons, but not both (i) and (ii), wherein the reaction product contains additional unsaturated carbon atoms, relative to (i) the first organic compound or (ii) the second organic compound, wherein the metals of the catalyst precursor composition are arranged in a crystal lattice, and wherein the reaction product is not located within the crystal lattice.

Embodiment 19

The method of embodiment 18, wherein said at least one metal from Group 6 is Mo, W, or a combination thereof, and wherein said at least one metal from Groups 8-10 is Co, Ni, or a combination thereof.

Embodiment 20

The method of embodiment 18 or 19, wherein said catalyst precursor composition further comprises at least one metal from Group 5 of the Periodic Table of the Elements, for example V, Nb, or a combination thereof.

Embodiment 21

The method of any of embodiments 18-20, wherein said first organic compound comprises a primary monoamine having from 10 to 30 carbon atoms, and/or wherein said second organic compound comprises only one carboxylic acid group and has from 10 to 30 carbon atoms.

Embodiment 22

The method of any of embodiments 18-21, further comprising heating the catalyst precursor to a temperature from about 195° C. to about 250° C. for a time sufficient for the first or second organic compounds to form a reaction product in situ that contains unsaturated carbon atoms not present in the first or second organic compounds.

Embodiment 23

The method of any of the above embodiments, wherein the heavy oil feedstock comprises a catalytic slurry oil.

Embodiment 24

The method of any of the above embodiments, wherein the conversion temperature is at least about 975° F. (524° C.), optionally at least about 1050° F. (566° C.).

What is claimed is:

1. A method for processing a heavy oil feedstock, comprising:

providing a heavy oil feedstock having a 10% distillation point of at least about 650° F. (343° C.); and exposing the heavy oil feedstock to a plurality of slurry hydroconversion catalysts under effective slurry hydroconversion conditions to form at least a plurality of liquid products, the effective slurry hydroconversion conditions being effective for conversion of at least about 80 wt % of the heavy oil feedstock relative to a conversion temperature, wherein the plurality of slurry hydroconversion catalysts consist of a first Mo-based catalyst and a second Fe-based catalyst, a ratio of Fe to Mo being about 8:1 to about 25:1.

2. The method of claim 1, further comprising separating the plurality of liquid products using one or more separators, wherein a first separator of the one or more separators separates a slurry hydroconversion effluent to form a second plurality of liquid products and a product comprising a slurry hydroconversion pitch, wherein at least a portion of the product comprising the slurry hydroconversion pitch is recycled for exposure to the plurality of slurry hydroconversion catalysts under the effective slurry hydroconversion conditions.

3. The method of claim 1, wherein the conversion temperature is at least about 975° F. (524° C.).

4. The method of claim 1, wherein the heavy oil feedstock comprises a catalytic slurry oil.

5. The method of claim 1, wherein the first Mo-based catalyst is formed from a first catalyst precursor comprising phosphomolybdic acid.

6. The method of claim 1, wherein the first Mo-based catalyst is formed from a first catalyst precursor while forming the second Fe-based catalyst from a second catalyst precursor.

7. The method of claim 6, wherein the first catalyst is formed from the first catalyst precursor in situ by reaction and/or decomposition of the first catalyst precursor in at least one of a hydroprocessing reaction zone environment and a pretreatment step, the first catalyst comprising catalytically active solid particulates.

8. The method of claim 1, wherein a concentration of the Mo of the first catalyst in the heavy oil feedstock is at least about 50 wppm.

* * * * *